US008826593B2

(12) United States Patent
Baek

(10) Patent No.: US 8,826,593 B2
(45) Date of Patent: Sep. 9, 2014

(54) LOUVER MODULE AND LOUVER SYSTEM EMPLOYING THE SAME

(75) Inventor: Kee Han Baek, Seoul (KR)

(73) Assignee: Bautek Co., Ltd., Hwaseong-Si (KR)

( * ) Notice: Subject to any disclaimer, the term of this patent is extended or adjusted under 35 U.S.C. 154(b) by 0 days.

(21) Appl. No.: 13/696,141

(22) PCT Filed: Mar. 21, 2011

(86) PCT No.: PCT/KR2011/001928

§ 371 (c)(1),
(2), (4) Date: Nov. 5, 2012

(87) PCT Pub. No.: WO2011/162469

PCT Pub. Date: Dec. 29, 2011

(65) Prior Publication Data

US 2013/0086843 A1 Apr. 11, 2013

(30) Foreign Application Priority Data

Jun. 22, 2010 (KR) ..... 10-2010-0059265

(51) Int. Cl.
*E06B 7/08* (2006.01)

(52) U.S. Cl.
USPC ..... 49/92.1; 49/82.1; 49/403

(58) Field of Classification Search
USPC ..... 49/74.1, 82.1, 92.1, 91.1, 403
See application file for complete search history.

(56) References Cited

U.S. PATENT DOCUMENTS 3,110,936 A * 11/1963 Berard ..... 49/91.1
4,316,493 A * 2/1982 Arena ..... 160/168.1 V
5,052,150 A * 10/1991 Chen ..... 49/82.1
5,216,837 A * 6/1993 Cleaver et al. ..... 49/82.1
5,379,551 A * 1/1995 Swapp ..... 49/82.1
5,775,399 A * 7/1998 Shields, Jr. ..... 160/176.1 R
5,941,021 A * 8/1999 Valls et al. ..... 49/92.1
6,145,251 A * 11/2000 Ricci ..... 49/82.1
6,314,680 B1 * 11/2001 Buckwalter et al. ..... 49/82.1
6,701,669 B1 * 3/2004 Yorgason ..... 49/82.1
6,848,213 B1 * 2/2005 Swapp ..... 49/82.1
6,901,701 B2 * 6/2005 Lee ..... 49/82.1
7,328,533 B1 * 2/2008 Coleman ..... 49/74.1
7,353,636 B1 * 4/2008 Anderson et al. ..... 49/82.1
7,389,609 B2 * 6/2008 Yorgason ..... 49/82.1
7,574,827 B2 * 8/2009 Huang et al. ..... 49/90.1
8,281,518 B2 * 10/2012 Marocco ..... 49/82.1
8,302,938 B2 * 11/2012 Ebeling ..... 256/59
8,393,379 B2 * 3/2013 Marocco ..... 160/172 R
2001/0037604 A1 * 11/2001 Gabriele ..... 49/74.1
2004/0226222 A1 * 11/2004 Young ..... 49/82.1
2005/0076569 A1 * 4/2005 Griffiths et al. ..... 49/82.1
2005/0252086 A1 * 11/2005 Yorgason ..... 49/82.1
2005/0257429 A1 * 11/2005 Yorgason ..... 49/82.1
2007/0101651 A1 * 5/2007 Nien ..... 49/92.1

(Continued)

FOREIGN PATENT DOCUMENTS

EP 399130 A1 * 11/1990 ..... E06B 7/086
EP 512227 A1 * 11/1992 ..... E06B 7/086

*Primary Examiner* — Jerry Redman

(74) *Attorney, Agent, or Firm* — Sughrue Mion, PLLC

(57) ABSTRACT

A louver module which has an improved ventilation control structure, operating method, material, and shape for imparting heat-resistance and water-tight properties and prevents a louver from deviating through mutual fixation and reinforcement among a plurality of materials, and a louver system employing the same. The louver module of includes a frame, an opening/closing mechanism, a louver unit and power transmission mechanism.

13 Claims, 30 Drawing Sheets

(56) References Cited

U.S. PATENT DOCUMENTS

| | | | | |
|---|---|---|---|---|
| 2007/0204513 | A1* | 9/2007 | Griffiths | 49/82.1 |
| 2008/0000157 | A1* | 1/2008 | Nien et al. | 49/82.1 |
| 2008/0178526 | A1* | 7/2008 | Browne et al. | 49/82.1 |
| 2009/0113798 | A1* | 5/2009 | Nieves Zeno | 49/92.1 |
| 2011/0099906 | A1* | 5/2011 | Marocco | 49/91.1 |
| 2011/0197513 | A1* | 8/2011 | Marocco | 49/82.1 |
| 2012/0085030 | A1* | 4/2012 | Marocco | 49/82.1 |
| 2013/0118082 | A1* | 5/2013 | Colson | 49/82.1 |

* cited by examiner

LOUVER MODULE AND LOUVER SYSTEM EMPLOYING THE SAME

CROSS REFERENCE TO PRIOR APPLICATIONS

This application is a National Stage Patent Application of PCT International Patent Application No. PCT/KR2011/001928 (filed on Mar. 21, 2011) under 35 U.S.C. §371, which claims priority to Korean Patent Application No. 10-2010-0059265 (filed on Jun. 22, 2010) which are all hereby incorporated by reference in their entirety.

TECHNICAL FIELD

The present invention relates to a louver module and a louver system employing the same, and more particularly, to a louver module which has an improved ventilation control structure, operating method, material, and shape for imparting heat-resistance and water-tight properties and prevents a louver from deviating through mutual fixation and reinforcement among a plurality of materials, and a louver system having the louver module coupled to a window chassis or door chassis.

BACKGROUND ART

A louver module is devised to screen the sun while reducing visual exposure to the exterior in a place where ventilation is frequently required, to prevent rainwater from flowing into the place in case of rain, and to ensure the ventilation.

In a case where the louver module is of a fixed type, the louver module of the fixed type is configured to be inclined at an angle of 40 to 50 degrees. The inclined angle of the louver is changed depending on an installation purpose or situation of the louver module. The louver module is generally installed in a place where ventilation is required, such as a machine room, parking lot or factory wall.

There has been developed an openable/closable louver module by improving a conventional louver module to be of a rotary type. The openable/closable louver module of the rotary type has excellent sealing performance and ventilation characteristics as compared with the conventional louver module of the fixed type.

The louver module of the rotary type is frequently installed in a place where a boiler in an apartment building, studio apartment or complex building are mounted or in a place where an outdoor unit of an air conditioner is mounted.

However, in the louver module of the rotary type, a louver and a frame are generally made of an aluminum material, and therefore, its heat-resistance effect is lowered. In a case where the temperature difference between the interior and exterior of a room is large, a dew condensation phenomenon occurs, and therefore, walls of the room are contaminated due to the formation of mold in the room.

Further, the conventional louver module of the rotary type has a problem in that sufficient water-tight properties between louvers are not ensured, and therefore, rainwater flows into the room.

Further, in the conventional louver module of the rotary type, a driving mechanism for rotating the louvers is structurally weak, and therefore, the locking state of the louvers is released or some of the louvers are deviated by a malfunction or external impact.

DETAILED DESCRIPTION

Technical Problems

It is thus an object of the present invention to provide a louver module having a rotatably openable/closable louver, in which a louver is configured to be made of a material having heat resistance, such as synthetic resin, and to include compartments in which several air layers are formed, so that it is possible to ensure the heat resistance and to prevent the occurrence of a dew condensation phenomenon even when the temperature difference between the interior and exterior of a room is large.

It is another object of the present invention to provide a louver module which can perform smooth ventilation when louvers are opened, ensure sealing performance between the louvers when the louvers are closed, and prevent rainwater from flowing into the interior of a room between the louvers and frames.

It is still another object of the present invention to provide a louver module in which a driving force is transmitted to a louver using a manual or electric worm gear, so that it is possible to perform a fine manipulation of the louver and to prevent an opening/closing of the louver from being changed by an external impact.

It is still another object of the present invention to provide a louver module in which louvers are firmly coupled to a frame by improving the structure of the louvers, so that it is possible to prevent a phenomenon that the louver is deviated or bent.

It is still another object of the present invention to provide a louver system in which the louver module is coupled to a window chassis or door chassis for ventilation, lighting and entrance.

Technical Solutions

To solve the objective, the present invention provides a louver module, including: a frame having horizontal and vertical frames assembled in a rectangular shape; an opening/closing mechanism assembled with any one of the vertical frames so as to provide torque using worm gears; a louver unit made of a synthetic resin material and including a plurality of louvers each having a compartment forming an air layer for heat resistance therein, wherein symmetrically-shaped brackets are respectively coupled to both ends in the length direction of the respective louvers, a reinforcing beam extended in the length direction is assembled inside each louver, at least one surface of outer surfaces of each louver has a streamline shape, and the plurality of louvers are rotatably mounted between the vertical frames constituting left and right sides of the frame while being horizontally spaced apart in vertical direction from one another; and a power transmission mechanism including a plurality of holders respectively disposed at positions corresponding to end portions of the louvers inside the vertical frames constituting the frame and a pair of shafts disposed inside each vertical frame, wherein each holder has one surface on which a fixing projection is formed and the other surface on which a pair of link projections are formed, the fixing projection of the holder is coupled to the end portion in the length of the reinforcing beam by passing through the vertical frame and the bracket, corresponding to the position of the fixing projection, the link projections of each holder are linked with the respective shafts, and the end portions of the pair of link projections of a specific holder corresponding to the mounting position of the opening/closing mechanism are mounted to the opening/closing mechanism by passing through the linked shafts, wherein the torque is transmitted to the specific holder from the opening/closing mechanism, the pair of shafts are driven in opposite directions to each other by rotation of the specific holder so that the torque is transmitted to other holders, as the holders inside the vertical frame forming one side of the frame are rotated, the torque is transmitted to the louver to be rotated, the holders inside the vertical frame forming the other side of the frame are rotated in connection with the rotation of the louvers coupled to the respective holders, and the pair of shafts inside the vertical frame forming the other side of the frame, which are linked with the holders, are driven in opposite directions to each other.

The opening/closing mechanism may include a driving mechanism providing an original driving force; a worm gear including a worm rotated by the original driving force transmitted from the driving mechanism and a first wheel tooth-combined with the worm 204 so as to generate the torque in a direction vertical to the original driving force; and a second wheel shaft-coupled to the first wheel of the worm gear so as to be rotated by receiving the torque transmitted from the first wheel, and coupled to the pair of link projections of the holder at a position corresponding to the second wheel.

The driving mechanism may include a knob shaft-coupled to the worm and rotated by a user's hand.

The driving mechanism may include an electric motor rotated by a user's manipulation and shaft-coupled to the worm.

The louver unit may further include.

The bracket of the louver unit may further include fixed louvers respectively coupled to uppermost and lowermost portions of the frame in a state corresponding to the state in which the louver is closed.

The bracket of the louver unit may further include at least one of a wedge and a fixing screw, which are coupled to an end portion in the length direction of the louver by passing through the bracket.

The louver may be coupled to the frame so that the streamline-shaped surface of the louver becomes an outer surface, each of the brackets respectively coupled to both ends in the length direction of the louver may further include a beak that comes in contact with a short edge formed on the vertical frame contacting the bracket in the state in which the louver is closed while being extended downward along the streamline-shape surface of the louver, and rainwater may be guided to the streamline-shaped surface of another louver positioned beneath the louver by the beak in the state which the louver is closed so as to prevent the rainwater from flowing in the interior.

A gasket may be further inserted into the louver so as to be parallel with the other surface of the louver, which contacts the streamline-shaped surface of another louver disposed beneath the louver in the state in which the louver is closed.

To solve the objective, the present invention provides a louver system, including: the louver module; and a chassis supporting the louver module to be rotatably opened/closed.

The chassis may support the louver module to be rotatably opened/closed using the horizontal or vertical direction as an axis.

The chassis may be assembled with the louver module to be rotatably opened/closed using the horizontal or vertical as the axis, and the chassis may be coupled to a window or door having a sliding opening/closing function or a hinged opening/closing function.

The chassis may be fixed and coupled to an external chassis.

Advantageous Effects

Based on the above structure, in the louver module having louvers of a rotary type, a louver is configured to be made of a material having heat resistance, such as synthetic resin, and to include compartments in which several air layers are formed, so that it is possible to ensure the heat resistance and to prevent the occurrence of a dew condensation phenomenon even when the temperature difference between the interior and exterior of a room is large.

Further, at least one surface of the louver is formed in a streamline shape, so that it is possible to perform smooth ventilation when the louvers are opened, ensure sealing performance between the louvers when the louvers are closed, and prevent rainwater from flowing into the interior of a room between the louvers and frames.

Further, a driving force is transmitted to the louver using a manual or electric worm gear, so that it is possible to perform a fine manipulation of the louver and to prevent an opening/closing of the louver from being changed by an external impact.

Further, the louvers are firmly coupled to a frame by improving the structure of the louvers, so that it is possible to prevent a phenomenon that the louver is deviated or bent.

Further, the louver system for various windows and doors can be implemented by coupling the louver module to various kinds of chassis such as window and door chassis for ventilation, lighting and entrance.

MODES FOR PRACTICING INVENTION

Figure 1:
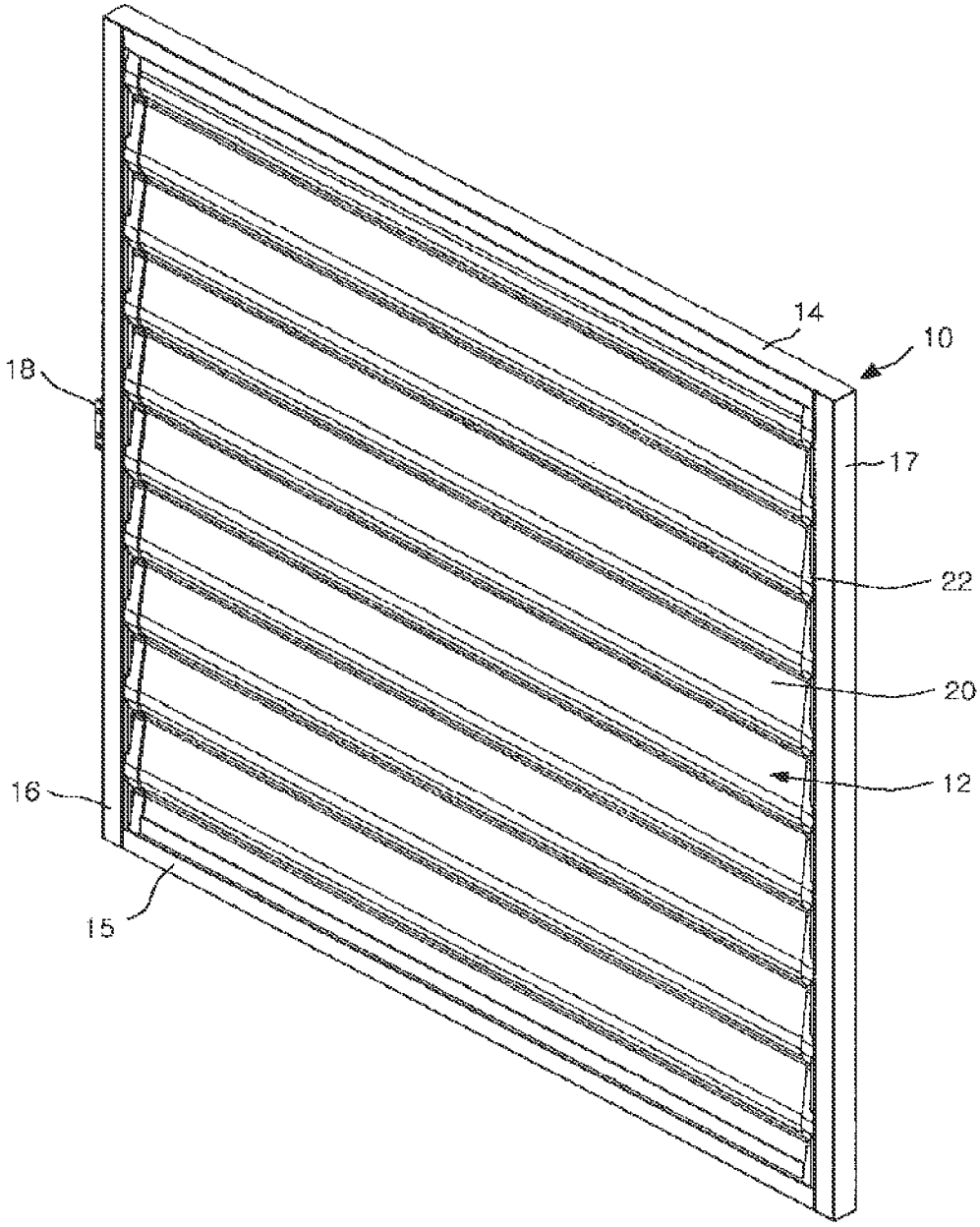
FIG. 1 is a perspective view illustrating an embodiment of a louver module according to the present invention.
Figure 2:
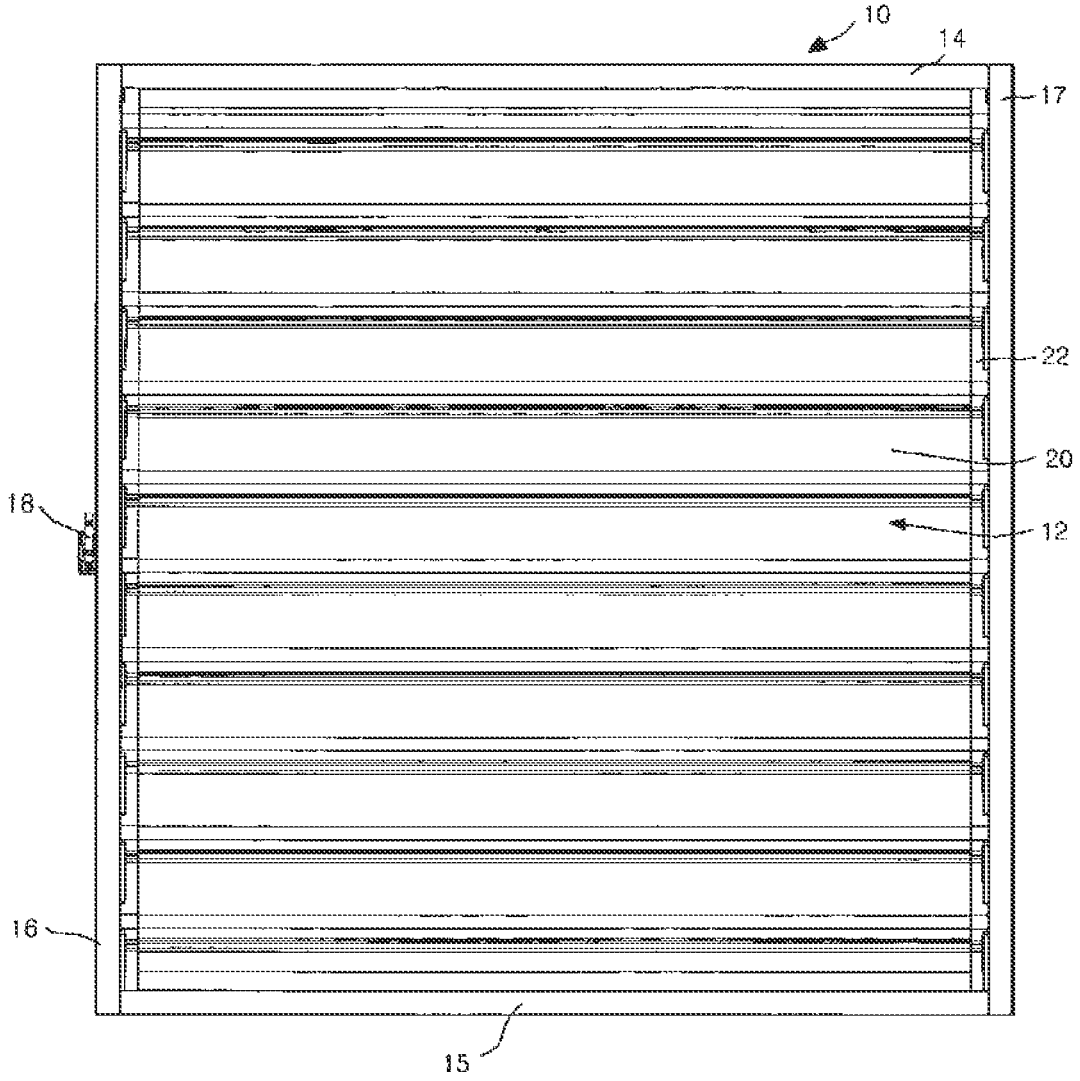
FIG. 2 is a front view of FIG. 1.
Figure 3:
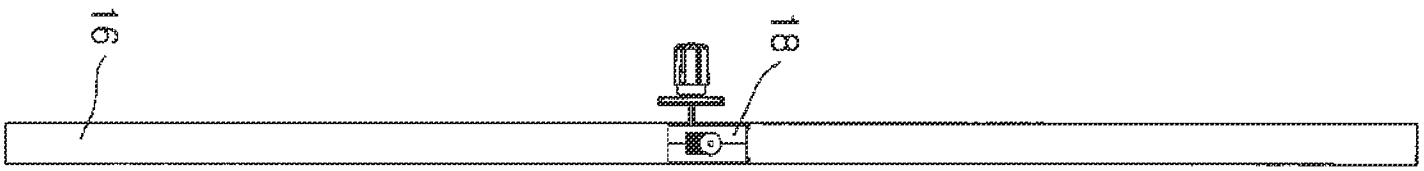
FIG. 3 is a left side view of FIG. 1.
Figure 4:
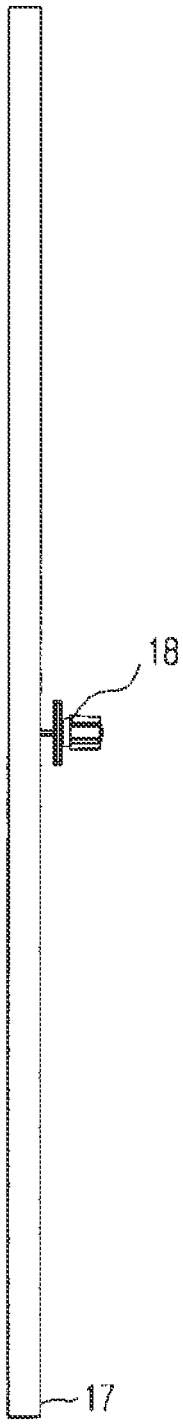
FIG. 4 is a right side view of FIG. 1.
Figure 5:
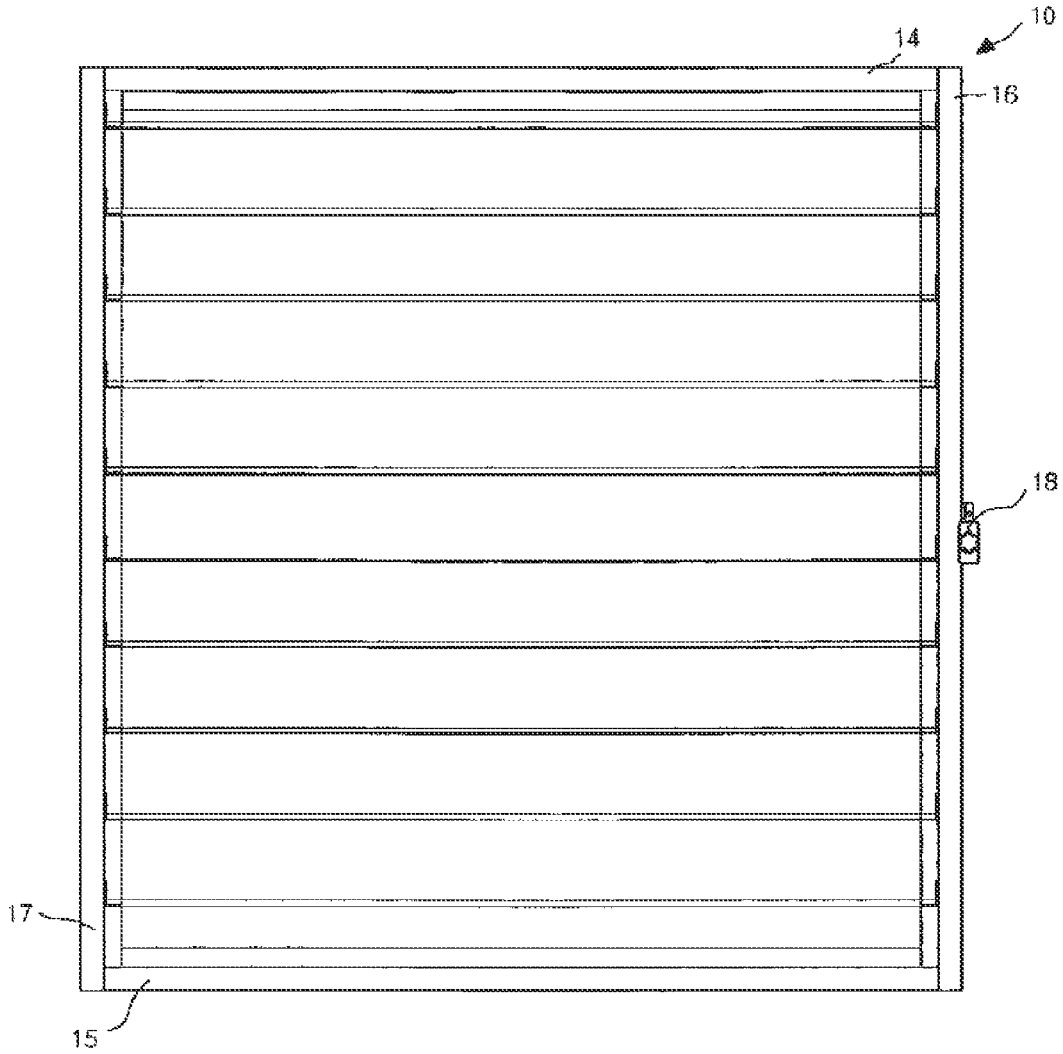
FIG. 5 is a rear view of FIG. 1.
Figure 6:
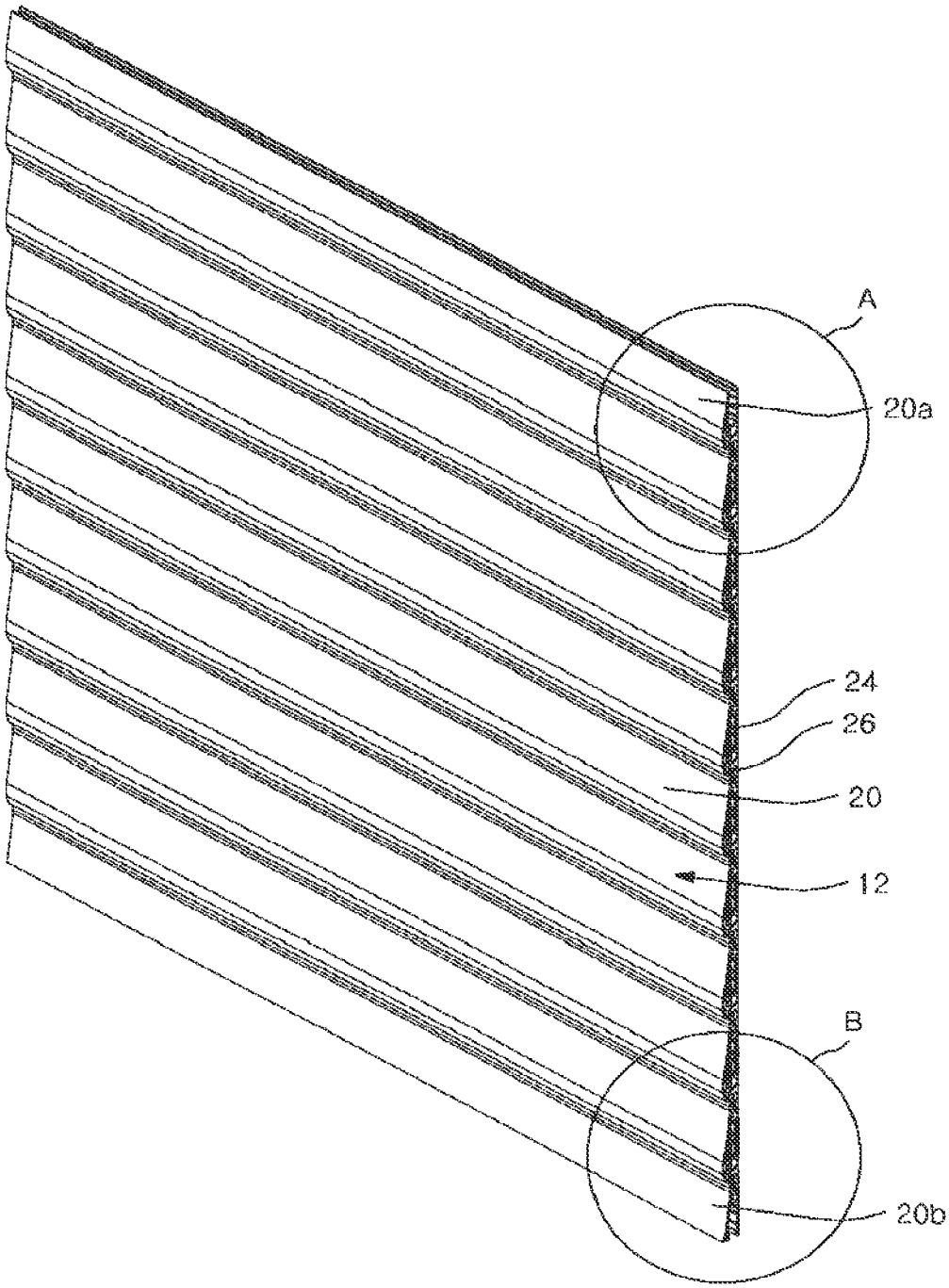
FIG. 6 is a perspective view of a louver unit.

The present invention now will be described more fully hereinafter with reference to the accompanying drawings, in which embodiments of the invention are shown. This invention should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 is a perspective view illustrating an embodiment of a louver module according to the present invention. FIGS. 2 to 5 are front, left side, right side and rear views of the embodiment, respectively.

In the louver module according to the embodiment of the present invention, a louver unit 12 is assembled in a rectangular frame 10.

Here, the frame 10 includes horizontal frames 14 and 15 and vertical frames 16 and 17, which are made of a synthetic resin material. The horizontal frames 14 and 15 and the vertical frames 16 and 17 are assembled into a rectangular shape. The assembled horizontal and vertical frames 14, 15, 16 and 17 are inserted into a window chassis or door chassis and are screened from the exterior, thereby ensuring heat resistance. The horizontal and vertical frames 14, 15, 16 and 17 are preferably made of a material having heat resistance, such as a synthetic resin material.

An opening/closing mechanism 18 is mounted to the vertical frame 16. The opening/closing mechanism 18 is used to drive the louver unit 12 by providing torque using worm gears described later.

Louvers 20 that occupy most of the area of the louver module according to the embodiment of the present invention are made of a synthetic resin material, and have a structure including a compartment for forming an air layer that acts as a buffer for heat resistance. Therefore, the louver module according to the embodiment of the present invention has heat resistance according to the material and structure of the louvers 20. That is, since the heat resistance of the synthetic resin material is generally superior to that of the aluminum material, the louvers 20 do not conduct external cool or warm air to the interior. The structure of the louvers 20 will be described later with reference to FIGS. 7 to 10.

When considering that the louver module according to the embodiment of the present invention is installed in a place where a boiler in an apartment building, studio apartment or complex building are mounted or in a place where an outdoor unit of an air conditioner is mounted, cooling and heating efficiency can be enhanced by the heat resistance of the frame 10, the louvers 20 and components constituting the louver module and a louver system employing the same. The components constituting the louver module and the louver system are preferably made of a heat-resistance material such as a synthetic resin material, in consideration of the heat resistance.

As described above, the frame 10 and the louver unit 12 has high heat resistance because of their material characteristics, so that it is possible to prevent a dew condensation phenomenon when the temperature difference between the interior and exterior of a room is large.

As configured in FIGS. 1 to 5, the louver unit 12 includes the louvers 20 and symmetrically-shaped brackets 22 coupled to both ends in the length direction of the respective louvers 20.

The louver unit 12 receives torque transmitted from the opening/closing mechanism 18 described later, and the louvers 20 are opened/closed by being rotated by the torque. Thus, louver unit 12 performs operations of opening the louvers 20 for the purpose of ventilation and closing the louvers 20 so as to prevent the ventilation from the exterior. The opening/closing of the louvers 20 is performed by being rotated by the torque transmitted from the opening/closing mechanism 18.

As shown in FIGS. 6 to 10, the louver 20 of the louver unit 12 has a streamline-shaped surface, and the louver unit 12 includes fixed louvers 20*a* and 20*b* respectively formed at upper and lower portion thereof. The louvers 20 are horizontally spaced apart in vertical direction from one another between the fixed louvers 20*a* and 20*b*.

The louver 20 has a streamline-shaped surface disposed toward the exterior when being mounted, and has a structure in which a bottom end in the width direction of one louver 20 is engaged with a top end in the width direction of another louver 20 in a state in which the one louver 20 is closed. A surface opposite to the streamline-shaped surface of the louver 20 may has a flat structure so as to form a flat vertical surface with respect to surfaces of other louvers disposed adjacent to the louver 20.

Figure 11:
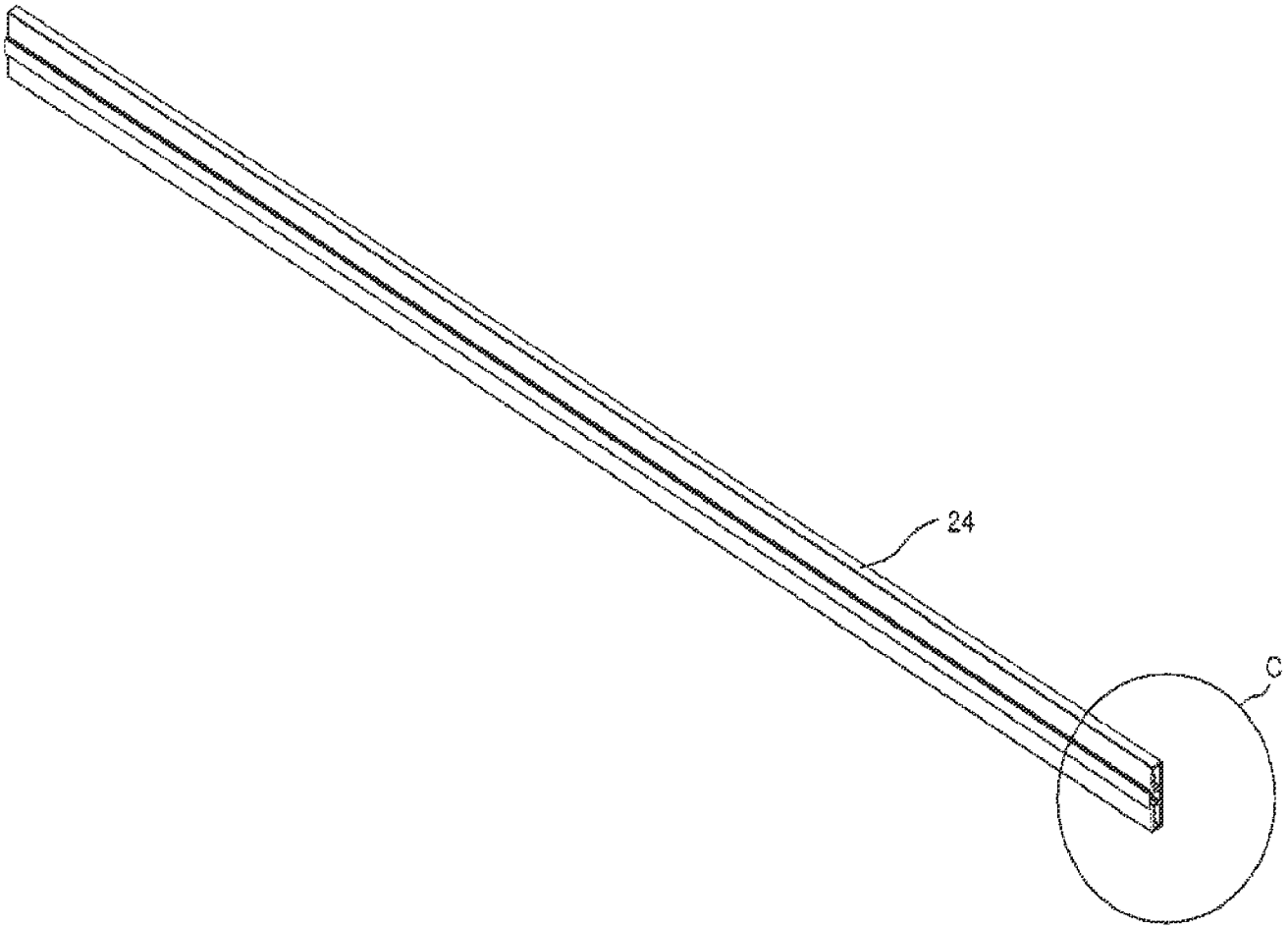
FIG. 11 is a perspective view of a reinforcing beam.
Figure 12:
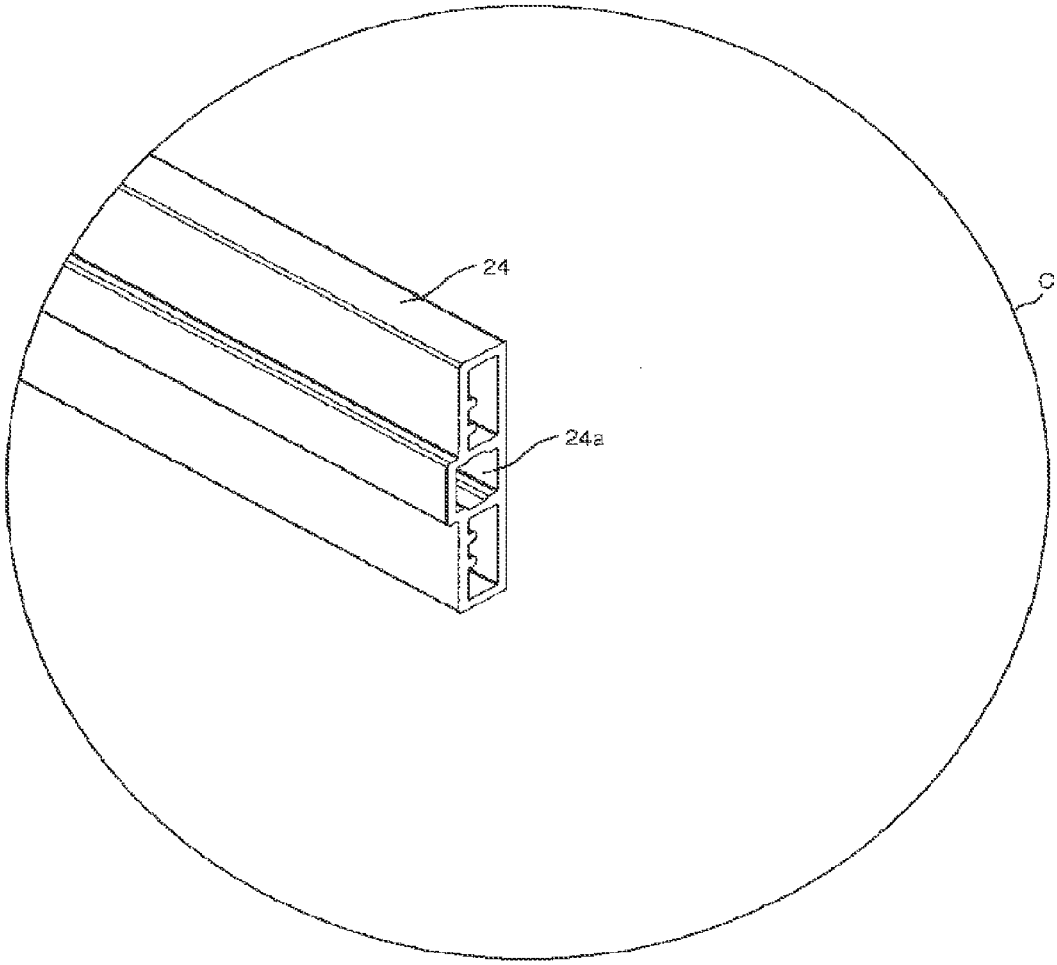
FIG. 12 is an enlarged perspective view of portion C of FIG. 11.
Figure 13:
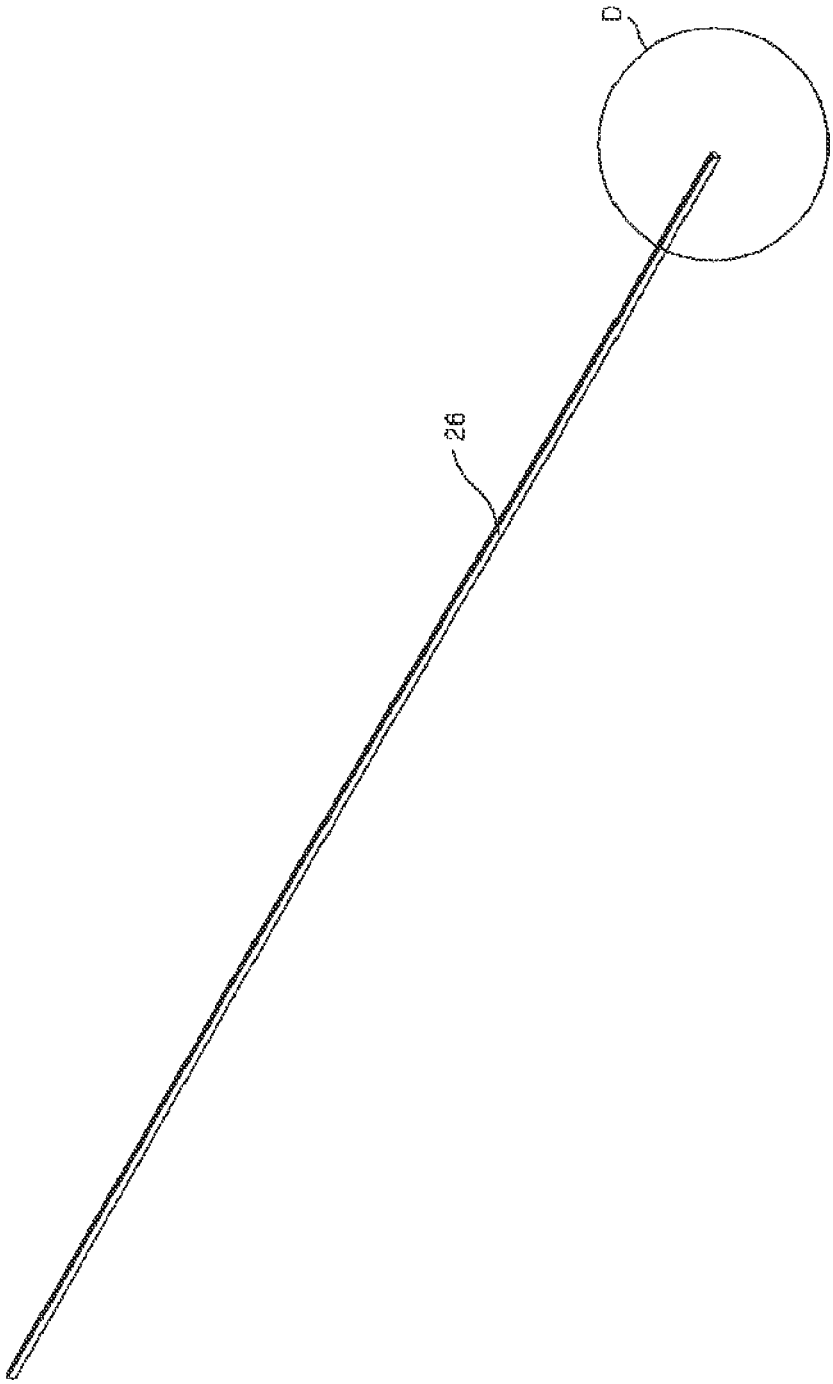
FIG. 13 is a perspective view of a gasket.
Figure 14:
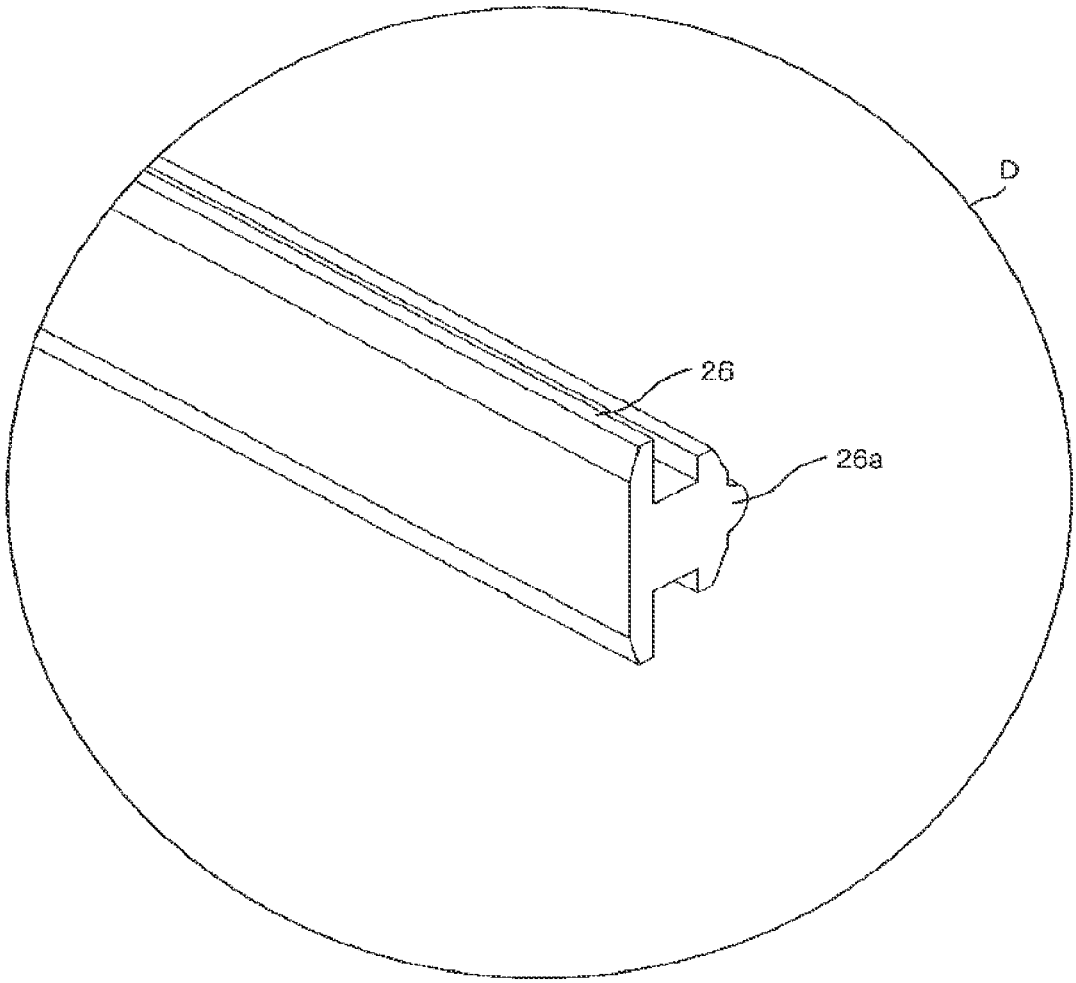
FIG. 14 is an enlarged view of portion D of FIG. 11.

A compartment 20*d* for buffering both surfaces of the louver 20 using an air layer in the interior thereof is formed inside the louver 20. Wedge grooves 20*h* and fixing screw grooves 20*c* are formed at upper and lower portions of the compartment 20*d*, respectively. The interior of the compartment 20*d* is preferably formed to have a space into which a reinforcing beam 24 having a shape shown in FIGS. 11 and 12 is inserted and to have projections 20*e* for supporting the reinforcing beam 24, protruded from the interior of the compartment 20*d*. A recessed portion into which a projection 26*a* of a gasket 26, which has a shape shown in FIGS. 13 and 14, is formed at one end of the louver 20.

Figure 7:
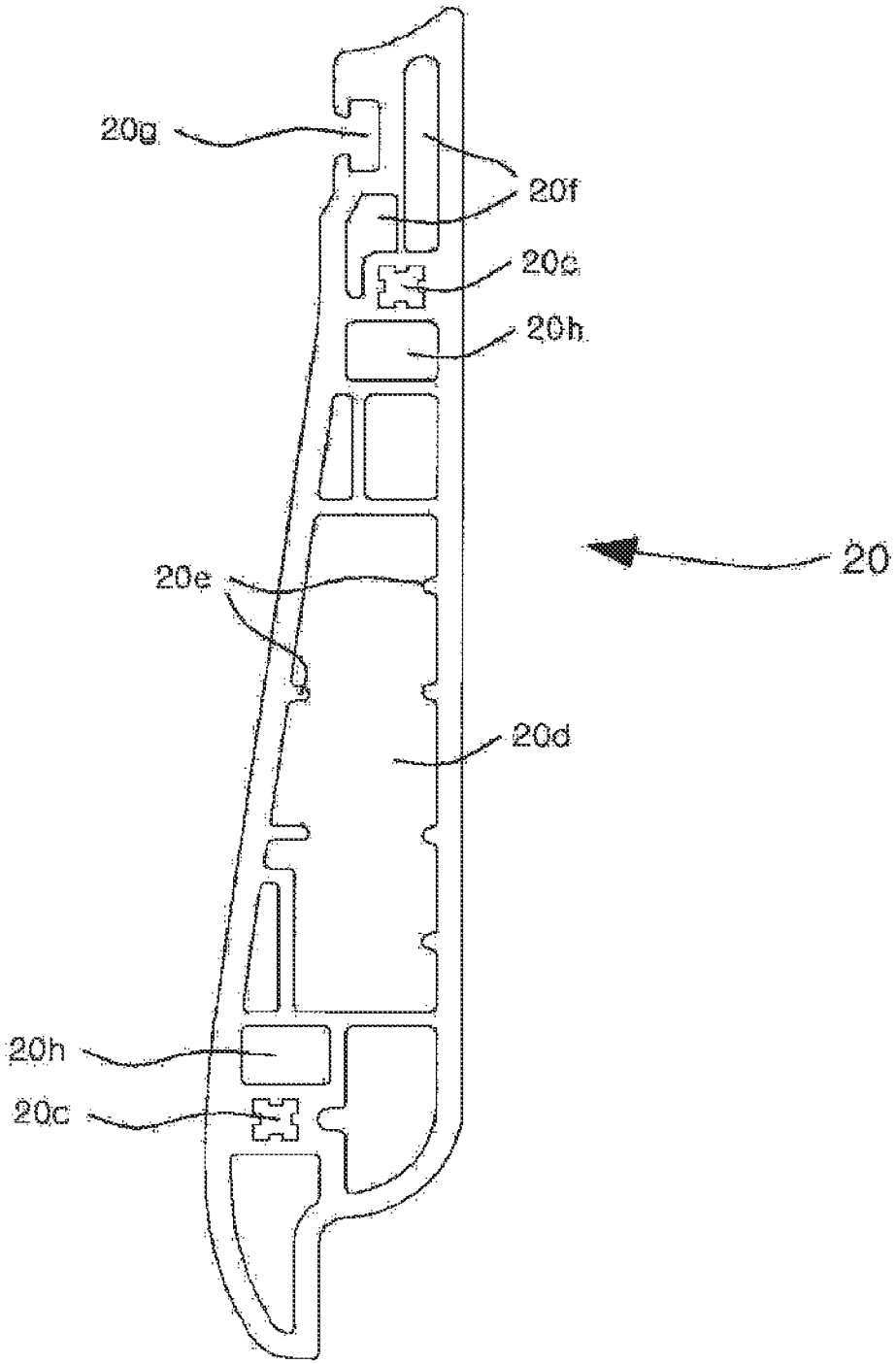
FIG. 7 is a side view illustrating the structure of an embodiment of a louver.
Figure 8:
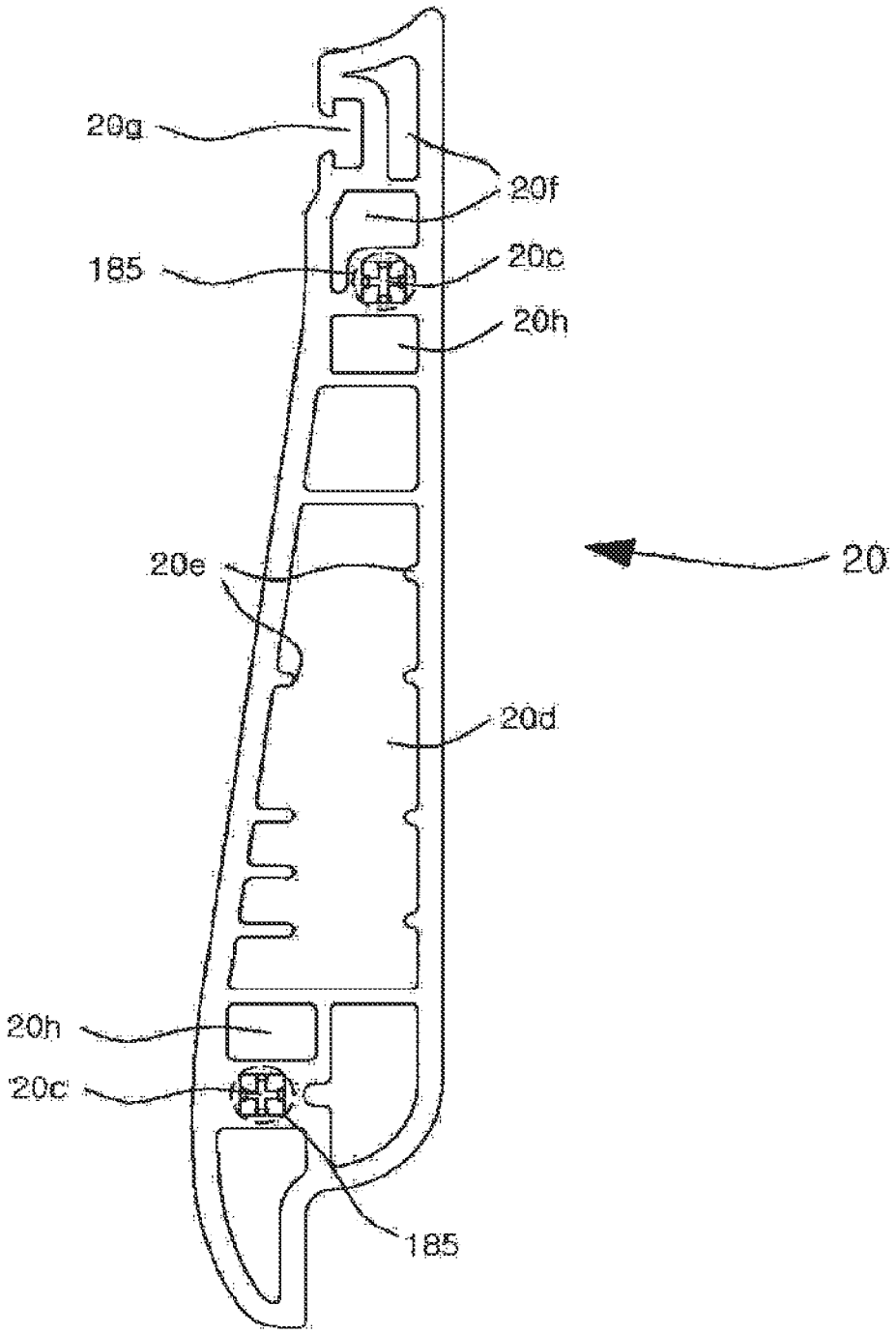
FIG. 8 is a side view illustrating the structure of another embodiment of the louver.
Figure 9:
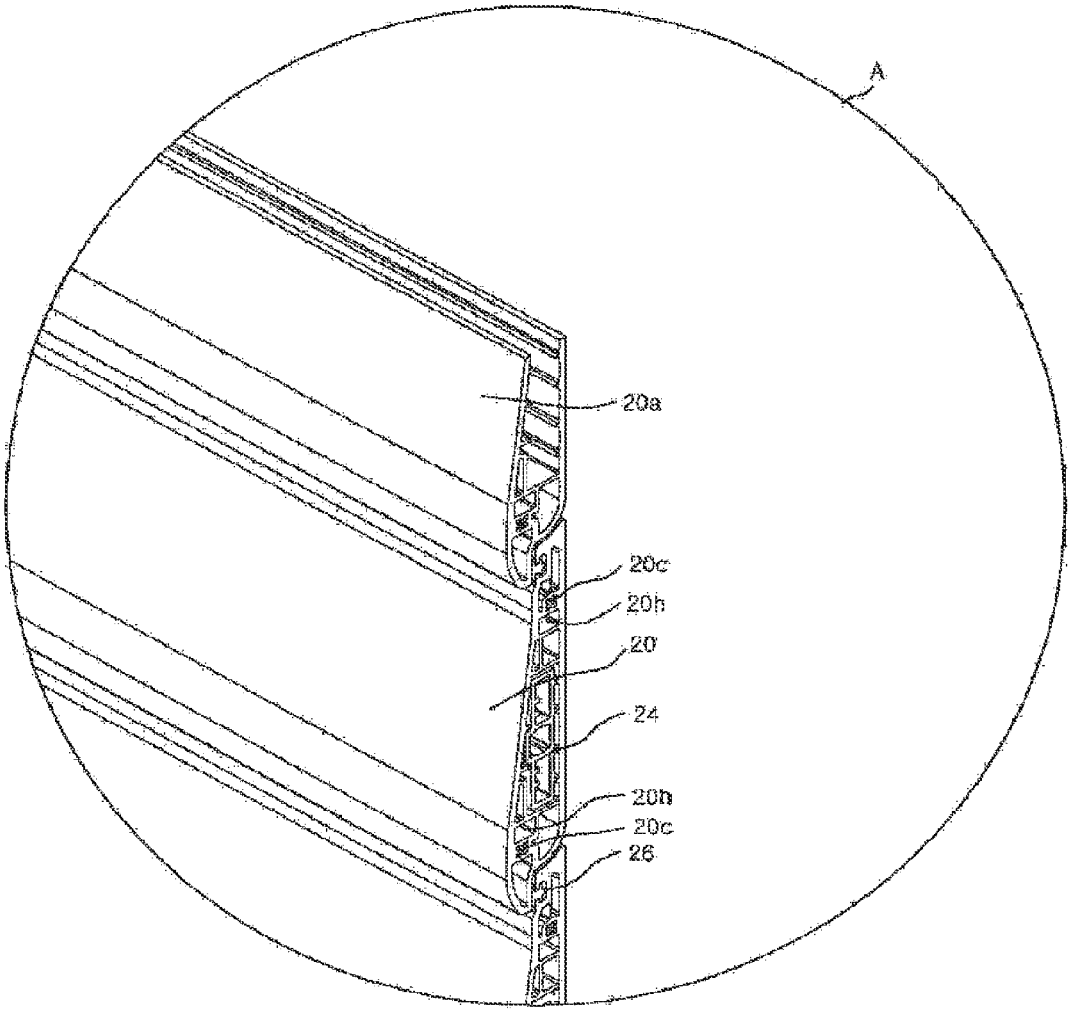
FIG. 9 is an enlarged perspective view of portion A of FIG. 6.
Figure 10:
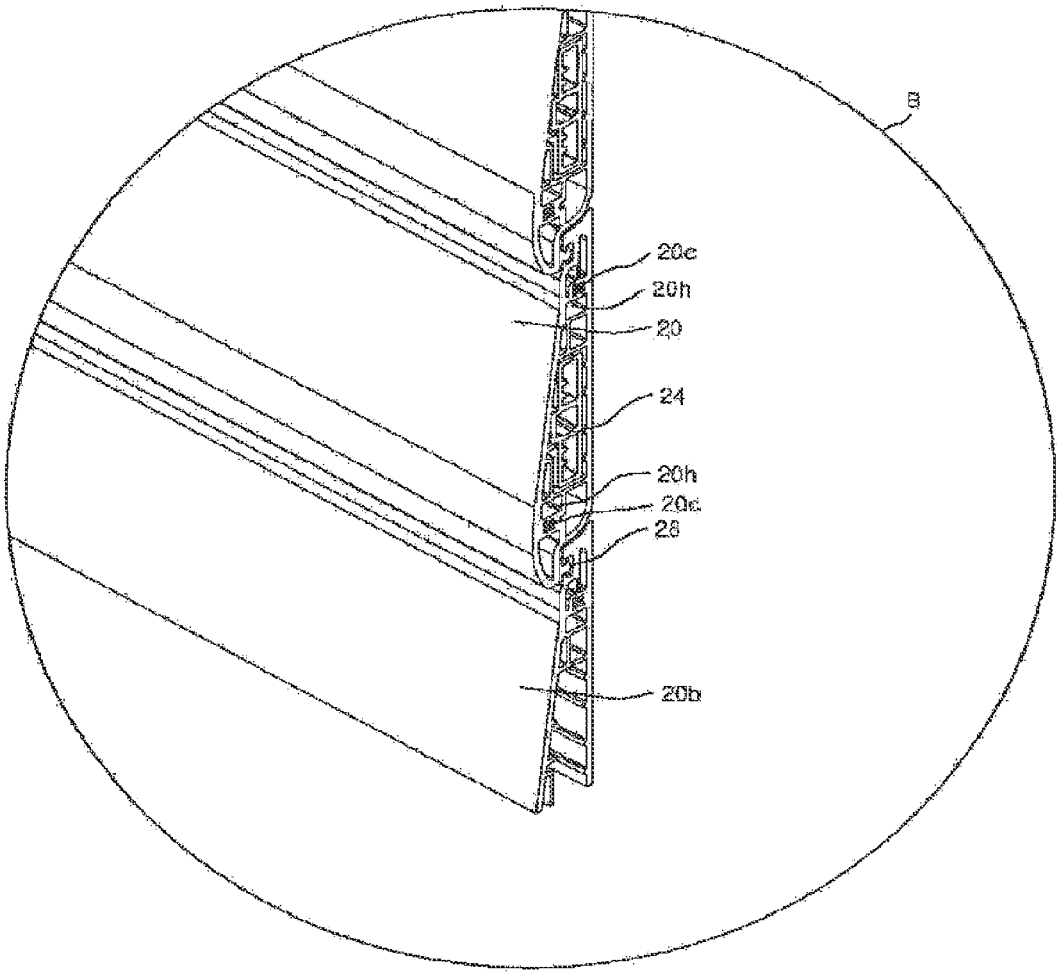
FIG. 10 is an enlarged perspective view of portion B of FIG. 6.

A reinforcing compartment 20 for forming an air layer may be configured in various shapes at each portion of the louver 20. As shown in FIG. 7 or 8, various reinforcing compartments may be formed in the louver 20, in consideration of the heat-resistance effect, etc. Meanwhile, in FIG. 8, reference numeral 185 denotes a fixing screw for illustrating a state in which the fixing screw 185 is coupled to the fixing screw groove 20*c*.

Hereinafter, the louver 20 configured according to the embodiment of the present invention is illustrated as one configured in an embodiment of FIG. 7. However, the louver 20 configured in an embodiment of FIG. 8 may be applied according to a manufacturer's intention. FIGS. 7 and 8 illustrate louvers in which the structure of the reinforcing compartment 20*f*, etc. is modified in consideration of the heat-resistance effect as described above.

Figure 20:
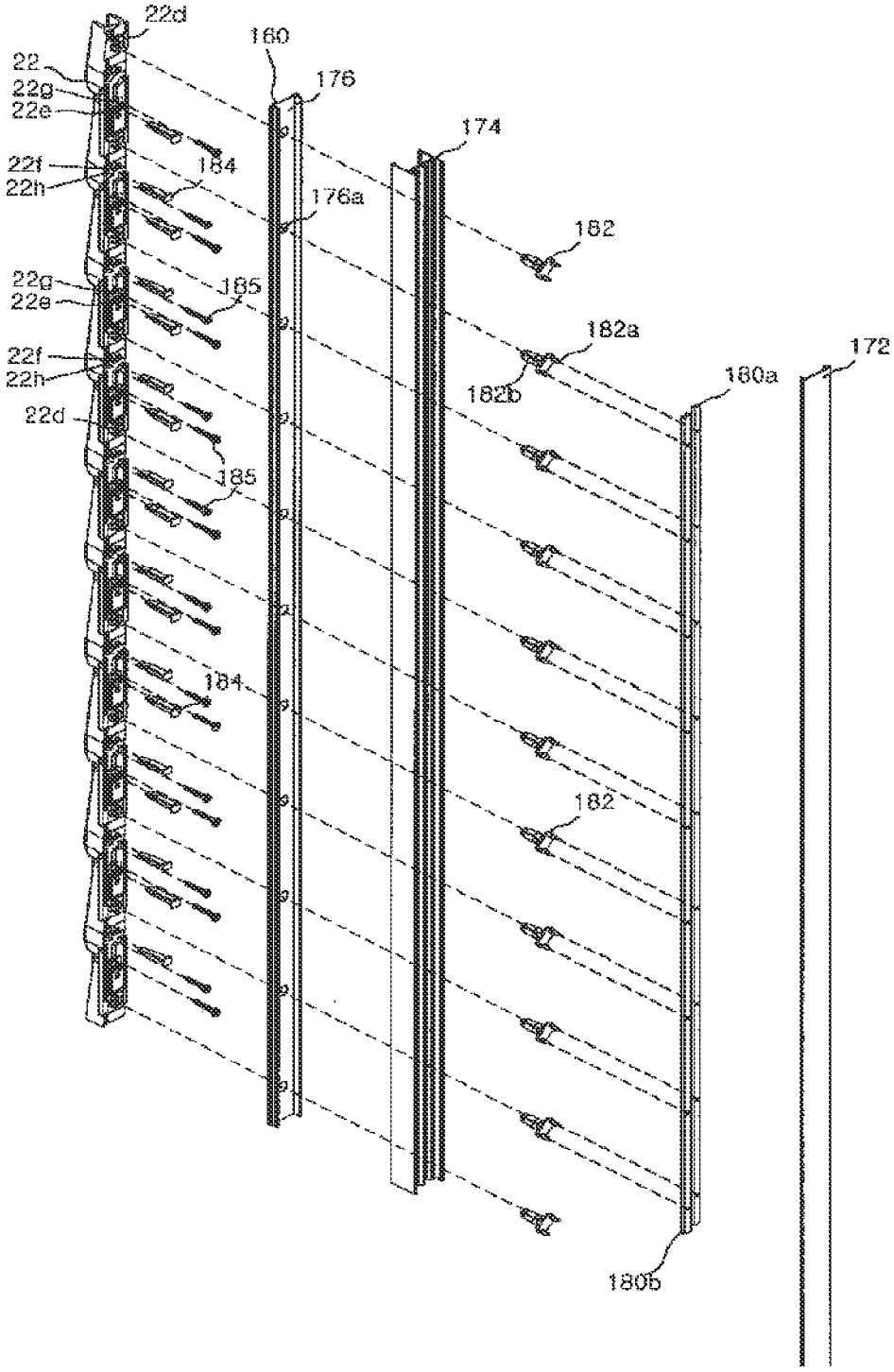
FIG. 20 is an exploded perspective view of a vertical frame.
Figure 21:
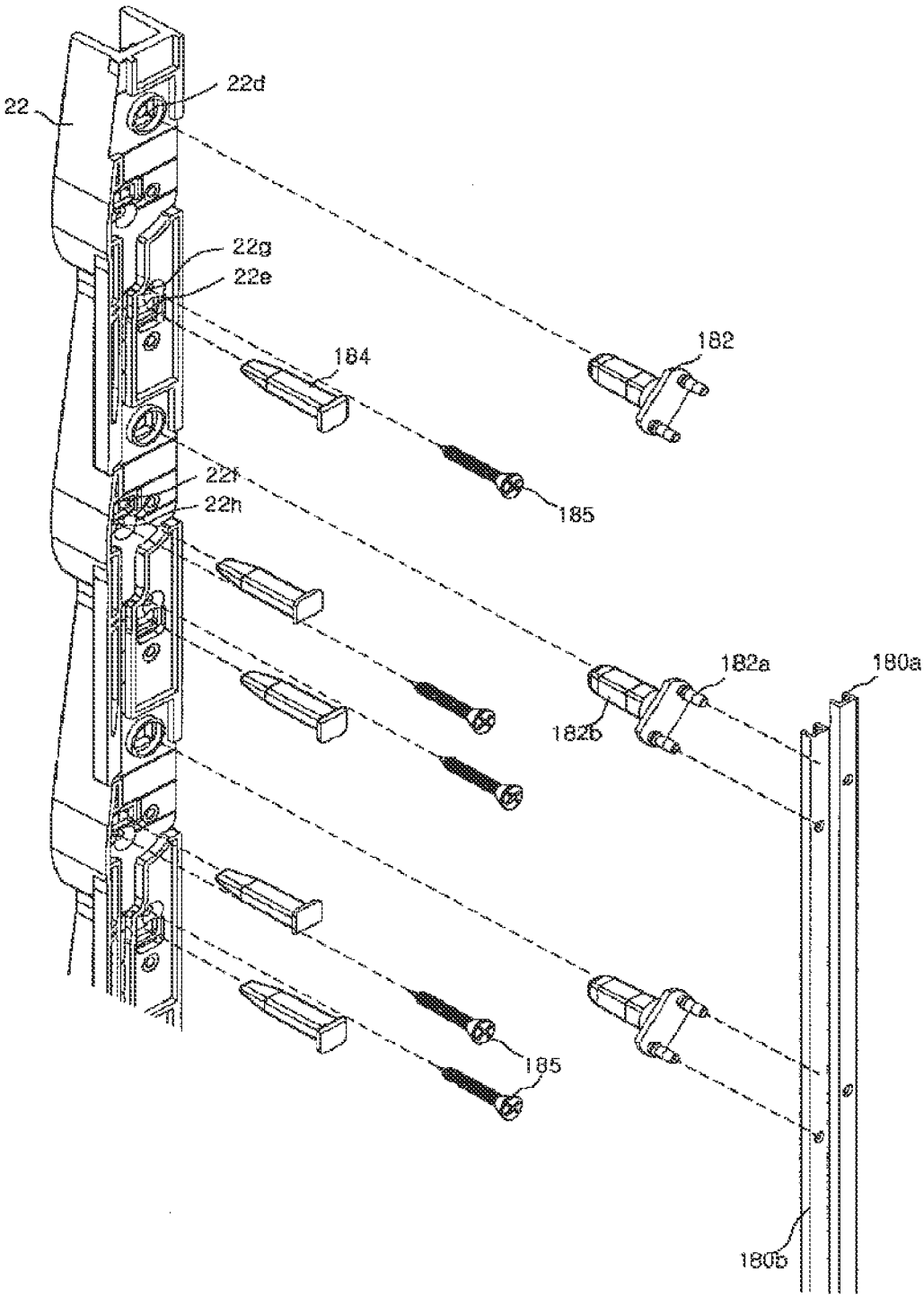
FIG. 21 is an exploded perspective view illustrating a configuration a power transmission mechanism inside the vertical frame.
Figure 22:
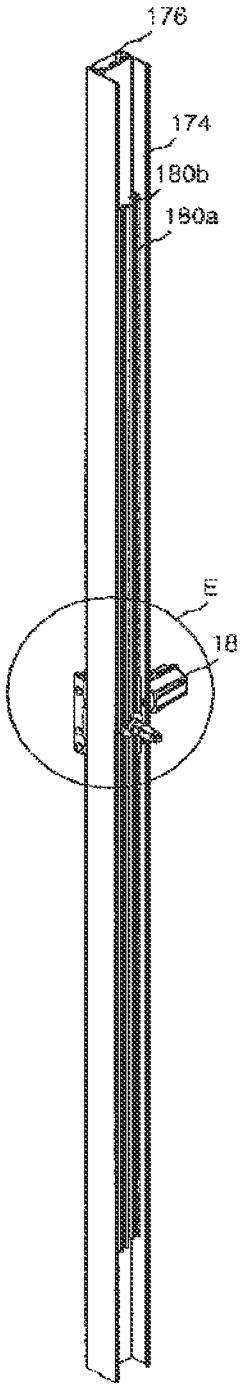
FIG. 22 is a perspective view illustrating the vertical frame and an opening/closing mechanism coupled to the vertical frame.

The reinforcing beam 24 having the shape shown in FIGS. 11 and 12 is assembled to the interior of the louver 20. The reinforcing beam 24 is provided with a fixing port 24*a* that has a shape extended in the length direction thereof and is inserted into the louver 20 so as to receive torque while being rotated together with the louver 20. A fixing projection of a holder, which will be described with reference to FIGS. 20 to 22, is inserted into the fixing port 24*a*.

The reinforcing beam 24 is inserted into the louver 20, so that it is possible to prevent a phenomenon that the louver 20 is bent due to strong wind pressure or physical environment applied from the exterior. The reinforcing beam 24 may be configured as a beam made of high-strength synthetic resin or metal such as aluminum.

The gasket 26 is inserted into the louver 20 so as to be parallel with the other surface of the louver 20, which contacts the streamline-shaped surface of another louver 20 disposed beneath the louver 20 in a state in which the louver 20 is closed. As shown in FIGS. 13 and 14, the gasket 26 has a shape extended in the length direction thereof, and is provided with an arrowhead-shaped projection 26*a* inserted into the recessed groove formed in the surface of the louver 20. The projection 26*a* is extended in the length direction of the gasket 26.

The gasket 26 is mounted at an end portion in the width direction of the louver 20, so that the sealing performance of the louver 20 can be ensured by the gasket 26 in a state in which the louver 20 is closed to be engaged with another louver 20. That is, inflow/outflow of a fine draft of air, inflow/outflow of cool or warm air, inflow of moisture, etc. can be blocked by the gasket 26. To this end, the gasket 26 may be formed of a synthetic rubber material such as an ethylene propylene dienimethylene linkage (EPDM), which has no change in temperature and no deformation caused by ultraviolet light.

Figure 15:
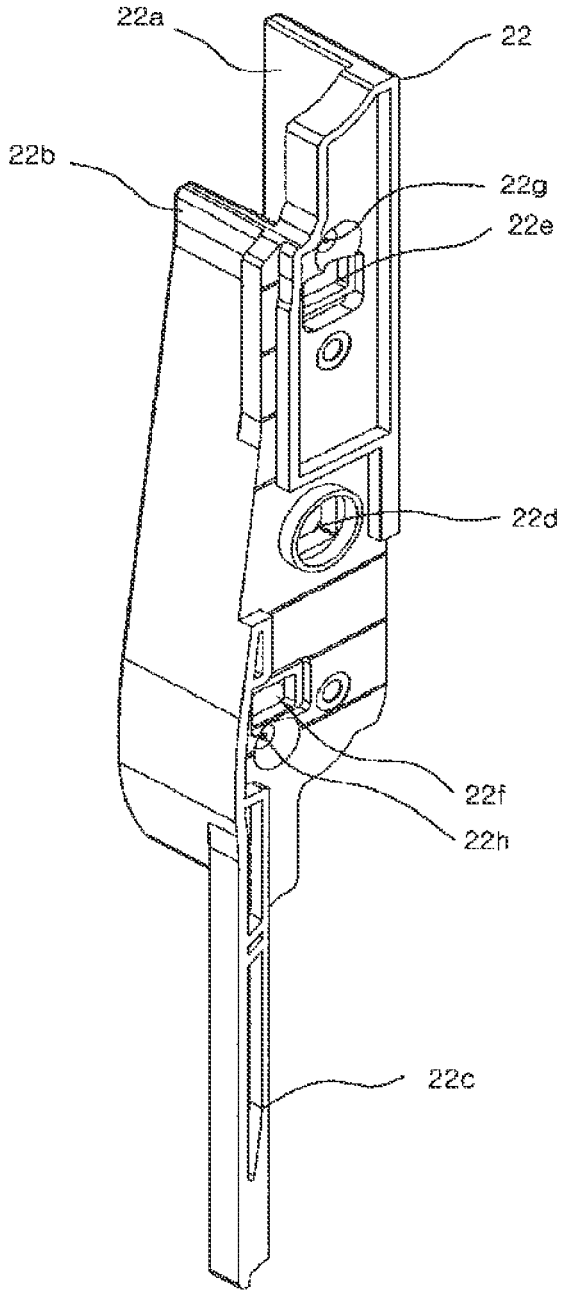
FIG. 15 is a perspective view of a bracket.
Figure 16:
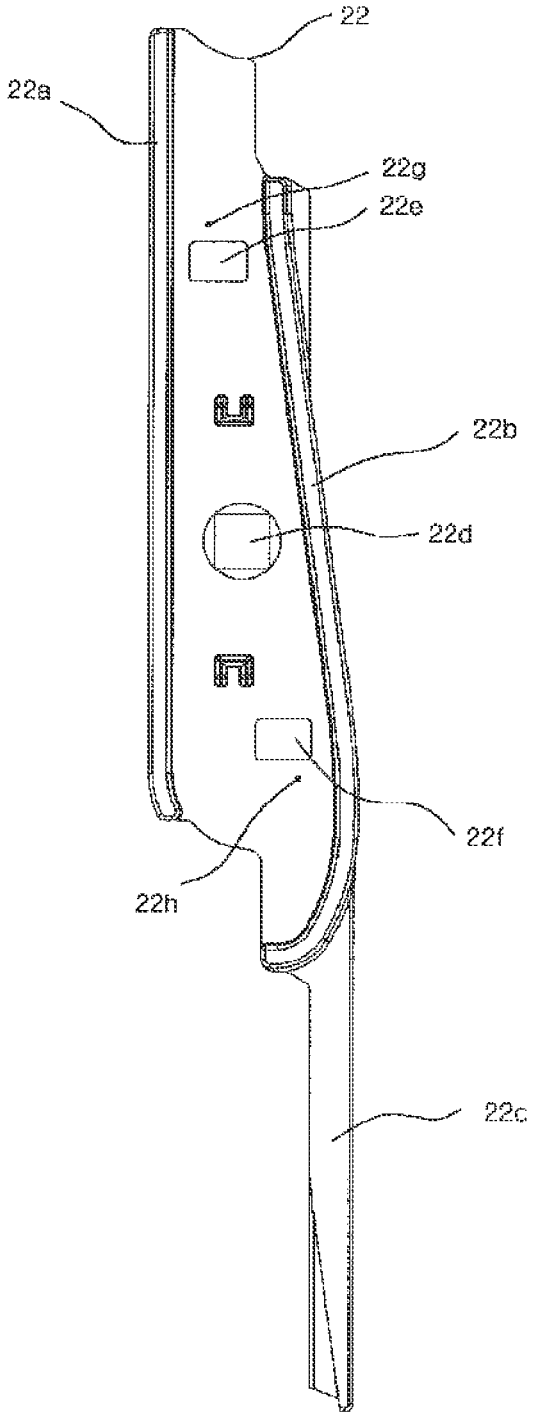
FIG. 16 is a left side view of the bracket.
Figure 17:
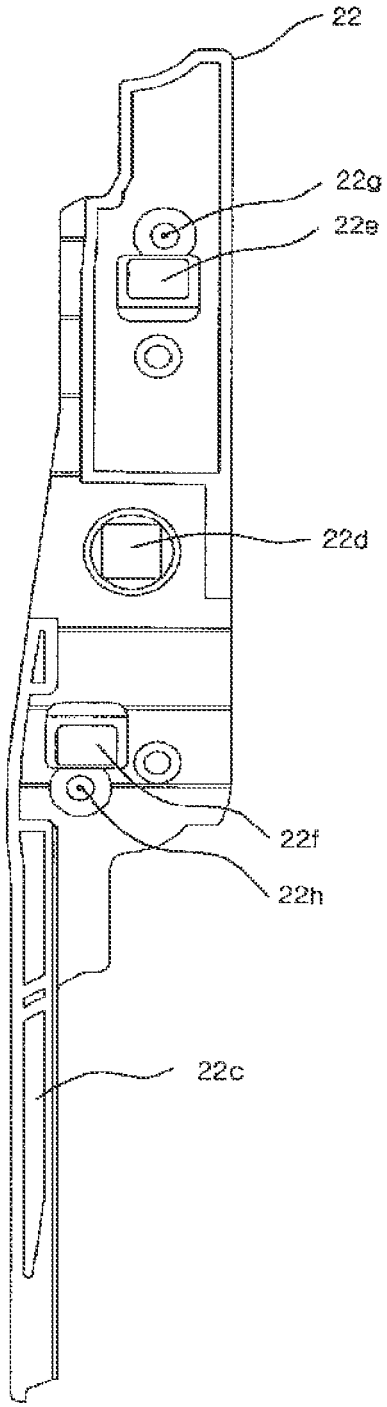
FIG. 17 is a right side view of the bracket.

The symmetrically-shaped brackets 22 are coupled to both the ends in the length direction of the respective louvers 20. The bracket 22 can be described with reference to the perspective view, the perspective, left side and right side views of FIGS. 15 to 17. The bracket 22 may be made of a synthetic resin material.

The bracket 22 is provided with holding portions 22*a* and 22*b* protruded on one surface so as to hold an end portion in the length direction of the louver 20.

The bracket 22 has a beak 22*c* that comes in contact with a short edge (160 of FIG. 20) formed at a side of each vertical frame 16 or 17 contacting the louver 20 in the state in which the louver 20 is closed while being extended downward along the streamline-shaped surface of the louver 20. As the beak 22*c* comes in contact with the short edge 160 of each vertical frame 16 or 17, the flow of rainwater is induced to the streamline-shaped surface of another louver 20 disposed beneath the louver 20 in the state in which the louver 20 is closed. That is, the beak 22*c* can prevent exterior rainwater from flowing between the louver 20 and each vertical frame 16 or 17.

A holder hole 22*d* which a fixing projection 182*b* of a holder 180, which will be described later with reference to FIGS. 20 to 22, passes through is formed at the center of the bracket 22. Wedge holes 22*e* and 22*f* which will be described later with reference to FIGS. 20 to 22 are formed in a region adjacent to the holder hole 22*d*. Fixing screw holes 22*g* and 22*h* are formed adjacent to the wedge holes 22*e* and 22*f*, respectively.

Figure 18:
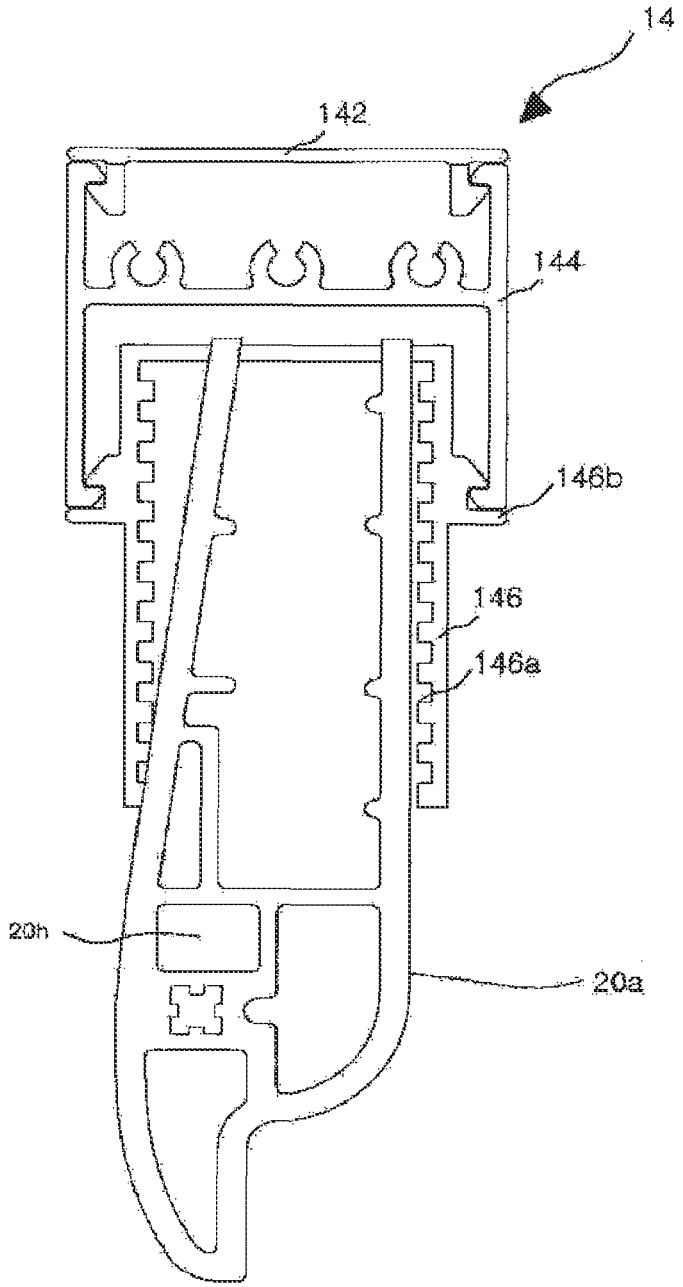
FIG. 18 is a side view illustrating a state in which an upper fixing louver of the louver unit and an upper horizontal frame are coupled to each other.

Meanwhile, as shown in FIG. 18, the horizontal frame 14 is assembled at an upper portion of the fixed louver 20*a* disposed at the upper portion of the louver unit 12, and the horizontal frame 15 is assembled at a lower portion of the fixed louver 20*b* disposed at the lower portion of the louver unit 12.

Referring to FIG. 18, the upper portion of the fixed louver 20*a* is inserted into a clipping horizontal frame 146. Projections may be formed on an inner wall of the clipping horizontal frame 146 so as to support the coupling state with the fixed louver 20*a* inserted into the clipping horizontal frame 146, and a support 146*b* for maintaining the coupling state with a main horizontal frame 144 may be formed on an outer wall of the clipping horizontal frame 146.

The main horizontal frame 144 has an upwardly opened channel and a downwardly opened channel. The clipping horizontal frame 146 is inserted into the downwardly opened channel of the main horizontal frame 144, and the upwardly opened channel of the main horizontal frame 144 is closed by being coupled to a cover horizontal frame 142.

Here, a short edge formed at an end portion of the upwardly opened channel of the main horizontal frame 144 is fastened with a short edge formed on a bottom surface of the cover horizontal frame 142, so that the assembling state between the main horizontal frame 144 and the cover horizontal frame 142 can be supported. In addition, a short edge formed at an end portion of the downwardly opened channel of the main horizontal frame 142 is fastened with the support 146*b* formed on the outer wall of the clipping horizontal frame 146, so that the assembling state between the main horizontal frame 144 and the clipping horizontal frame 146 can be supported.

Figure 19:
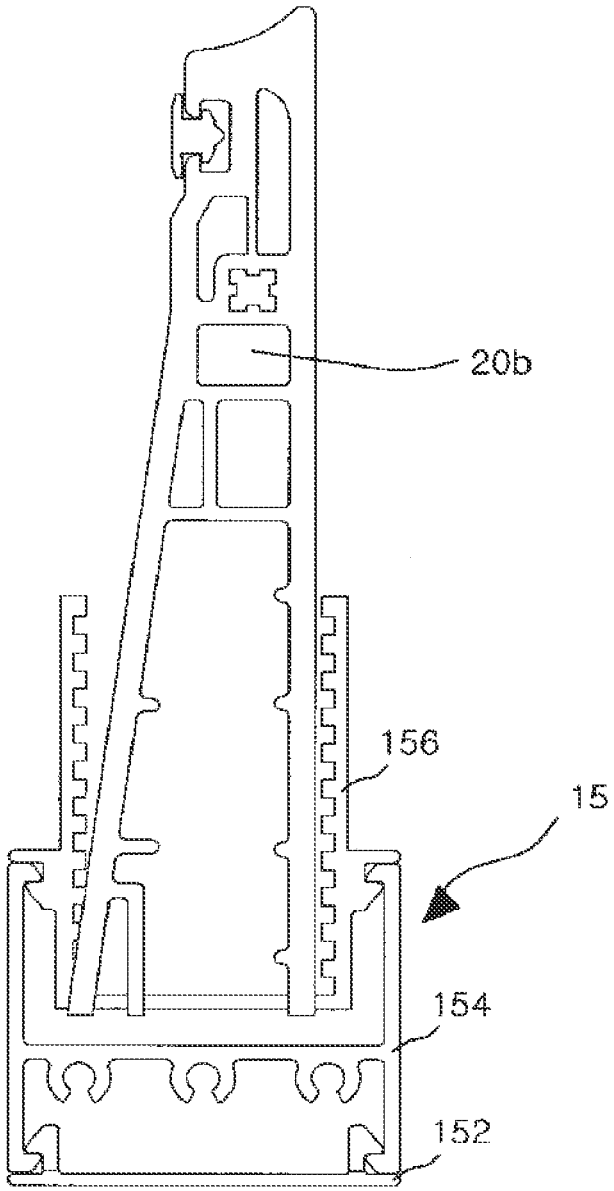
FIG. 19 is a side view illustrating a state in which a lower fixing louver of the louver unit and a lower horizontal frame are coupled to each other.

Referring to FIG. 19, the lower portion of the fixed louver 20*b* is also coupled to a clipping horizontal frame 156 of the horizontal frame 15, and the horizontal frame 15 having the same structure as the horizontal frame 14 as described in FIG. 18 is coupled to the fixed louver 20*b*. Thus, the coupling structure of the clipping horizontal frame 156, the main horizontal frame 154 and the cover horizontal frame 152 can be described with reference to FIG. 19, and its detailed description will be omitted to avoid redundancy.

The fixed louvers 20*a* and 20*b* of FIGS. 18 and 19 are illustrated as ones applied by partially cutting away the upper and lower ends of the louvers 20 shown in FIGS. 7 and 8. Any one of the louver 20 according to the embodiment of FIG. 7 and the louver 20 according to the embodiment of FIG. 8 may be selected as the fixed louvers 20*a* and 20*b*.

The configuration of the vertical frames 16 and 17 will be described with reference to FIGS. 20 and 21.

The vertical frames 16 and 17 are coupled to the bracket 22 coupled to the louvers 20. Each vertical frame 16 or 17 includes a cover vertical frame 172, a main vertical frame 174 and a side vertical frame 176. A pair of shafts 180*a* and 180*b* and holders 182 corresponding to the respective brackets 22 are included between the main vertical frame 174 and the cover vertical frame 172. Here, the holder 182 and the pair of shafts 180*a* and 180*b* are included in a power transmitting mechanism.

First, a pair of wedges 184 passing through the bracket 22 are inserted into the wedge grooves 20*h* of the louver 20 through the wedge holes 22*e* and 22*f*, respectively. A pair of fixing screws 185 passing through the fixing screw grooves 22*g* and 22*h* of the bracket 22 are inserted into the fixing screw grooves 20*c* of the louver 20, respectively. Accordingly, the bracket 22 and the louver 20 can have a firm fixing structure through the coupling using the wedges 184 and the fixing screws 185, and the wedges 184 and the fixing screws 185 can prevent the louver 20 from being deviated from the holder 182 due to an external impact.

The coupling between the cover vertical frame 172 and the main vertical frame 174, which constitute each vertical frame 16 or 17 may be implemented to have the same structure as the coupling between the horizontal frame 144 or 154 and the cover horizontal frame 142 or 152. The main vertical frame 174 and the side vertical frame 176 may also has a structure in which short edges of the main vertical frame 174 and the side vertical frame 176 are engaged with each other so as to support the coupling state between the main vertical frame 174 and the side vertical frame 176.

A fixing projection 182*b* is formed on one surface of the holder 182, and a pair of link projections 182*a* are formed on the other surface of the holder 182.

The fixing projection 182*b* of the holder 182 is fixed to the bracket 22 by being inserted into the fixing port 24*a* of the reinforcing beam 24 in the louver 20 while passing through a through-hole formed in the main vertical frame 174, a through-hole 176*a* formed in the side vertical frame 176 and the holder hole 22*d* formed in the bracket 22.

The pair of link projections 182*a* of the holder 182 may be rotatably linked to each shaft 180*a* or 180*b* while passing through each shaft 180*a* or 180*b*. If the shaft 180*a* is ascended by the linkage described above, the shaft 180*b* is descended, and accordingly, the holders 182 respectively disposed in the vertical frames 16 and 17, which form one sides linked with the shafts 180*a* and 180*b*, can be linked and rotated.

The opening/closing mechanism 18 may be mounted to any one of the vertical frames 16 and 17 described above. Although it has been illustrated in the embodiment of the present invention that the opening/closing mechanism 18 is mounted to the vertical frame 16 constituting a left side of the frame 10, the opening/closing mechanism 18 may be mounted to the vertical frame 17 constituting a right side of the frame 10 as shown in FIG. 22.

Figure 23:
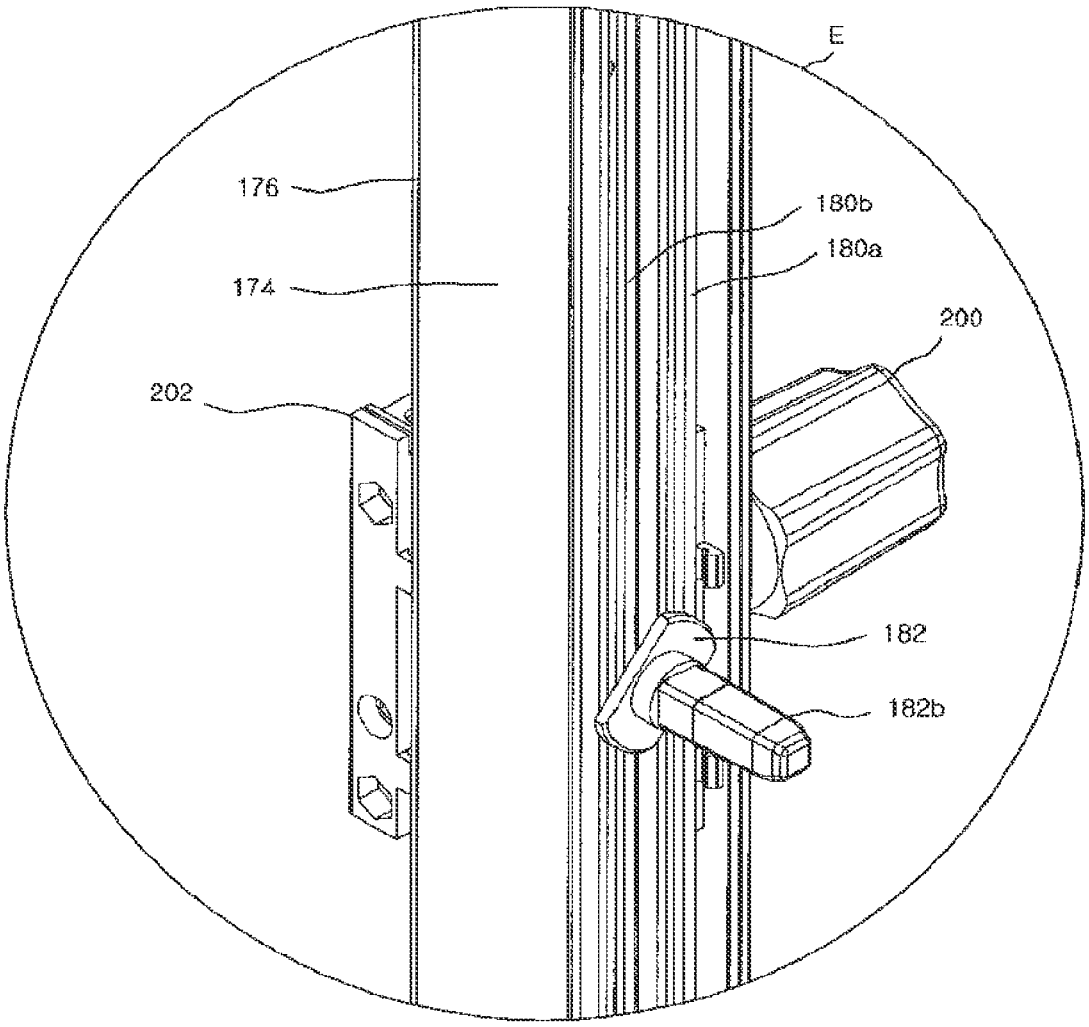
FIG. 23 is an enlarged view of portion E.
Figure 24:
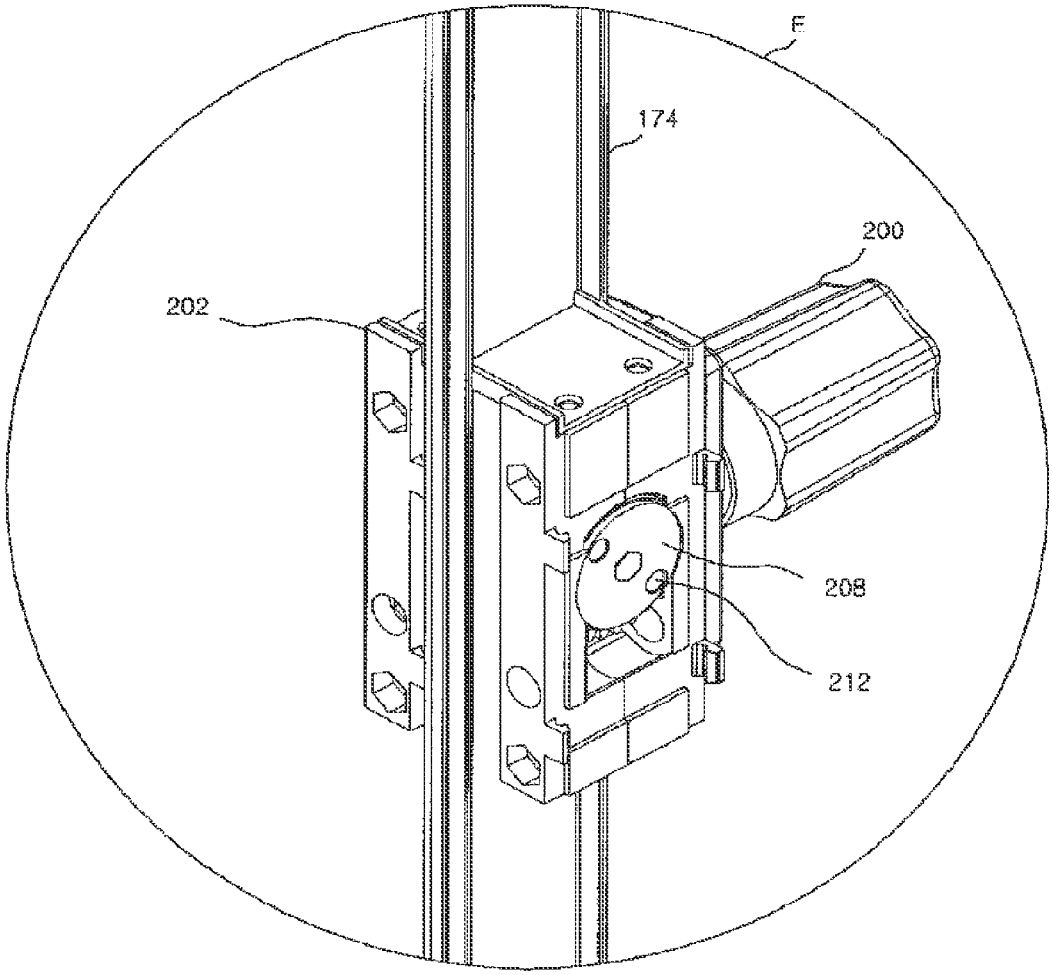
FIG. 24 is an enlarged perspective view illustrating a state in which a main vertical frame is removed from the portion E.
Figure 25:
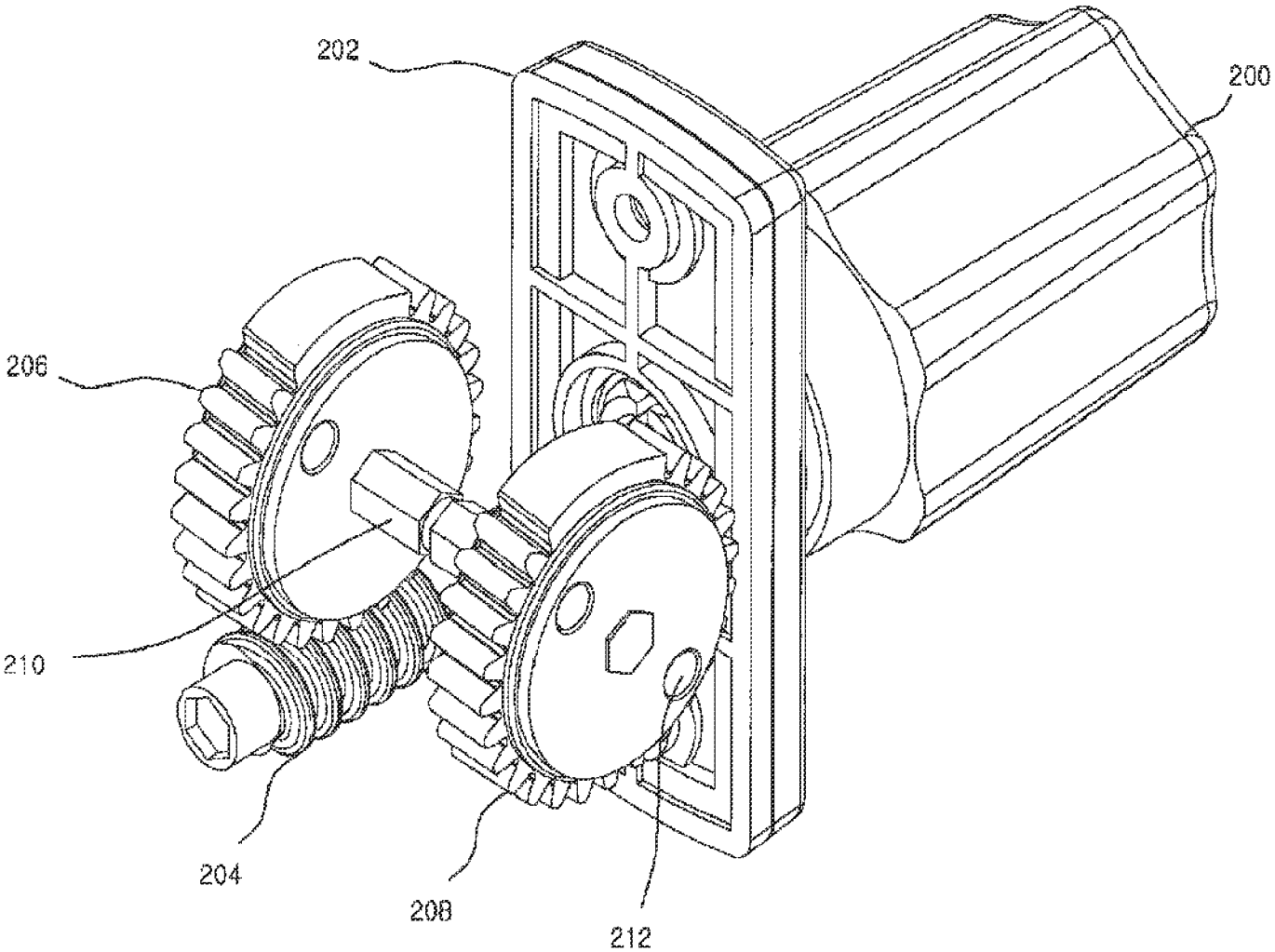
FIG. 25 is an enlarged perspective view of the opening/closing mechanism in a state in which a side vertical frame is removed and a case is opened.

The opening/closing mechanism 18 of FIG. 22 will be described in detail with reference to FIGS. 23 to 25.

The opening/closing mechanism 18 includes a knob 200, and a worm 204 and wheels 206 and 208 are included in a case 202. The knob 200 is shaft-coupled to the worm 204. If a user rotates the knob 200, the worm 204 may be rotated in connection with the knob 200. The worm 204 and wheel 206 are tooth-combined with each other, and the rotational directions of the worm 204 and the wheel 206 vertically intersect with each other. Accordingly, the torque of the worm 204 is generated by the original driving force of the knob 200, and the torque of which direction is vertically changed by the wheel 206 is generated by the wheel 206. The wheels 206 and 208 are disposed in parallel, and are connected to each other through a shaft 210. The torque of the wheel 206 is horizontally transmitted to the wheel 208.

Here, the worm 204 and wheel 206 may be disposed at the exterior of the cover vertical frame 176, and the wheel 208 may be disposed between the cover vertical frame 176 and the main vertical frame 178. A pair of link holes 212 are formed in the wheel 208, and the pair of link projections 182*a* of the holder 182 are inserted into the pair of link holes 212, respectively.

A specific holder 182 is correspondingly coupled to the wheel 208, and the link projections 182*a* of the specific holder 182 are inserted into the link holes 212 by passing through the pair of shafts 180*a* and 180*b*, respectively.

The power transmitting mechanism including the opening/closing mechanism 18, the holder and the shaft is configured as described above. Thus, if a user rotates the knob 200 so as to open/close the louvers 20, an original driving force is transmitted to the knob 200 by the user, and the worm 204 is rotated in connection with the knob 200 by rotating the knob 200. Then, torque in the direction vertical to the worm 204 is generated by the wheel 206, and the wheel 206 transmits the torque to the wheel 208. The wheel 208 rotates the specific holder 182 coupled thereto.

The specific holder 182 drives the pair of shafts 180*a* and 180*b* within the vertical frame, in which the specific holder 182 is included, in opposite directions to each other. The driving of the pair of shafts 180*a* and 180*b* causes rotations of other holders 182 linked with the specific holder 182, and the holders 182 are rotated, so that the louvers 20 and the brackets 22 coupled to the respective holders 182 are rotated. In this case, the louvers 20 and brackets 22 are rotated using the respective holders 182 as rotary axes so as to be closed or opened according to the rotational direction of the louvers 20.

Figure 26:
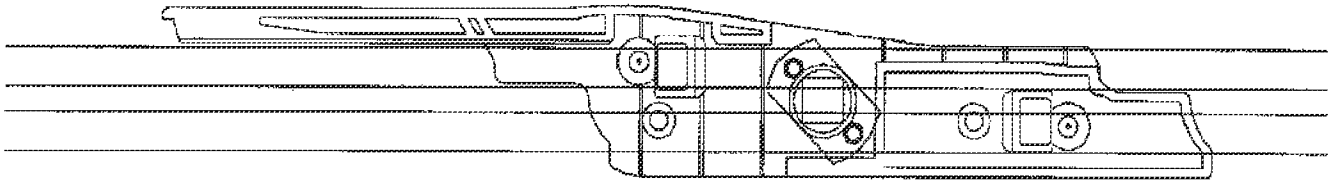
FIG. 26 is a schematic view illustrating a link state between the louver and a shaft in a state in which the louver is closed.
Figure 27:
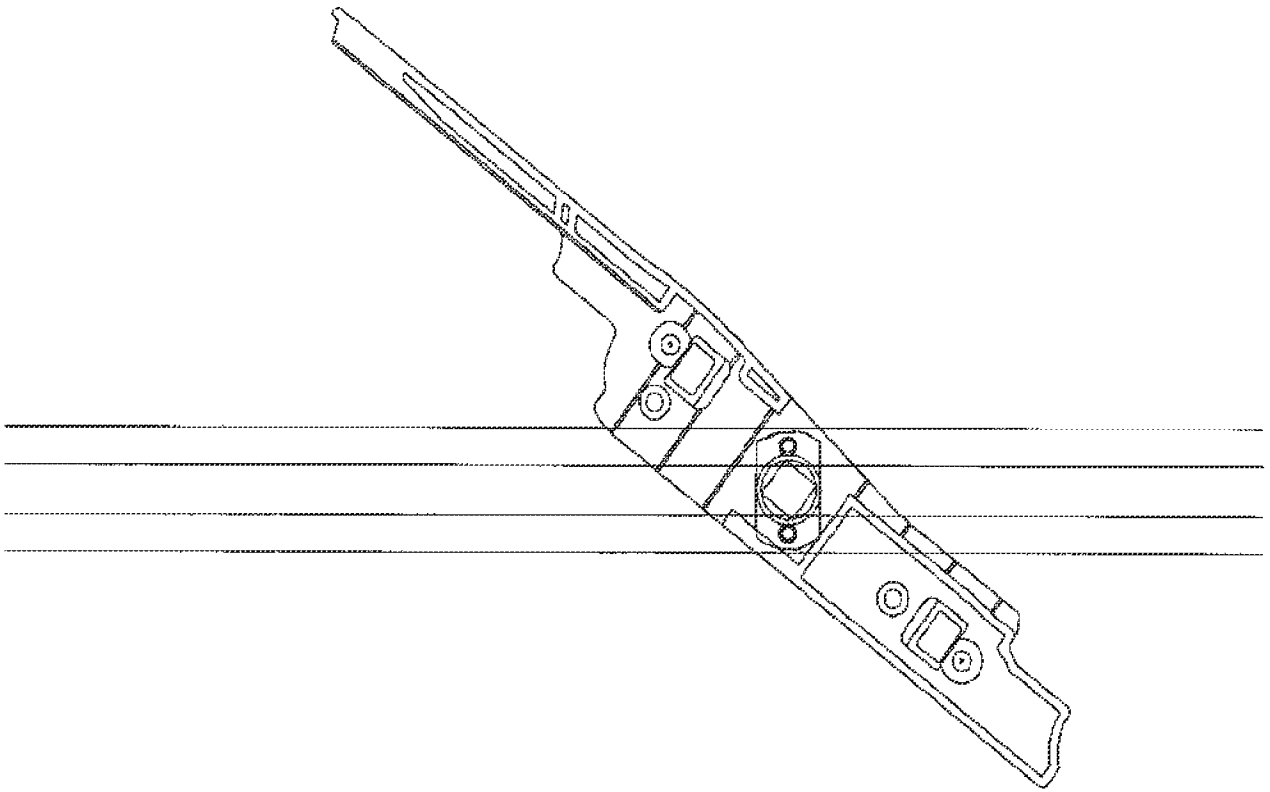
FIG. 27 is a schematic view illustrating a link state between the louver and the shaft in a state in which the louver is semi-opened.
Figure 28:
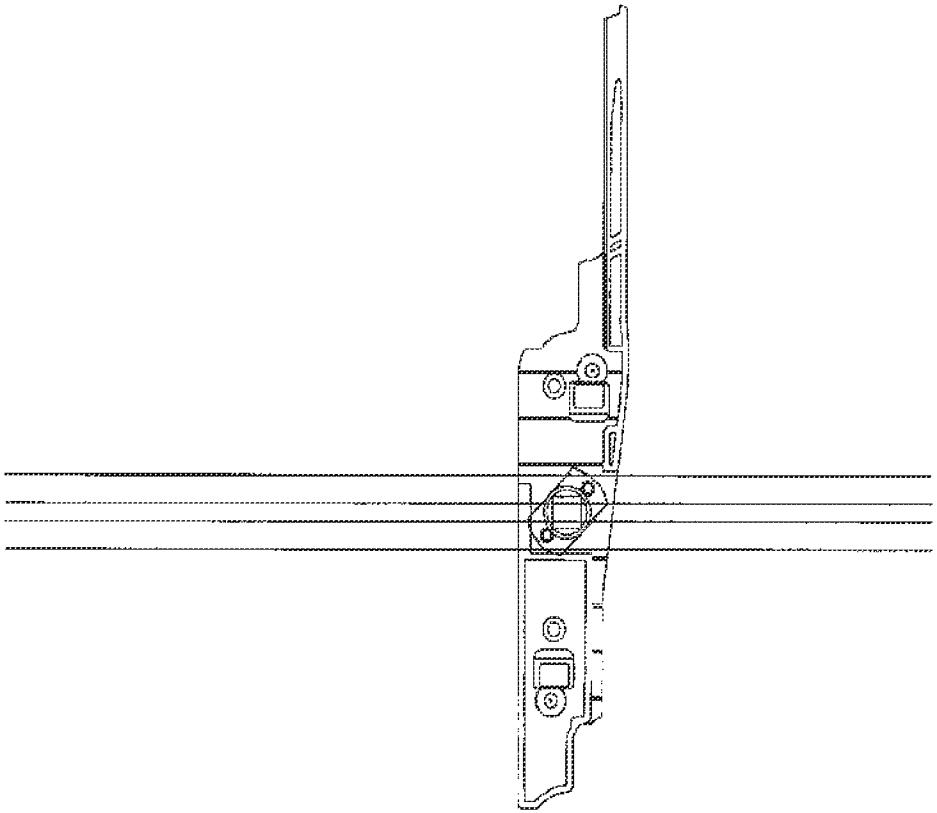
FIG. 28 is a schematic view illustrating a link state between the louver and the shaft in a state in which the louver is completely opened.

That is, the state of FIG. 26 is developed into the states of FIGS. 27 and 28, so that the louver 20 and bracket 22 can be opened. On the contrary, the state of FIG. 28 is developed into the states of FIGS. 27 and 25, so that the louver 20 and the bracket 22 can be closed.

In the configuration described above, an electric motor operated under a user's switch operation may be used other than the knob. In this case, the vibration motor may be configured so that the original driving force of which rotational direction is determined by the user's switch operation is transmitted to the worm by the electric motor.

As describe above, in the louver module according to the embodiment of the present invention, the louver 20 included in the louver unit is operated by a worm gear including the gear coupling between the worm 204 and the wheel 206, so that the opening/closing of the louver 20 can be controlled at a minute angle.

Since the worm 204 and the wheel 206 are engaged with each other through the gear coupling, the opening/closing state of the louver 20 is not easily changed even in the situation in which external pressure caused by a draft of air, etc. is applied to the louver 20. Thus, the opening/closing state of the louver 20 can be stably maintained.

Since the louver of the louver module according to the embodiment of the present invention is configured so that at least one surface of the louver has a streamline shape, an upward force is generated in air ventilated by the structure of the louver, and thus the flow velocity of the air can be increased. Accordingly, smooth ventilation can be achieved.

Figure 29:
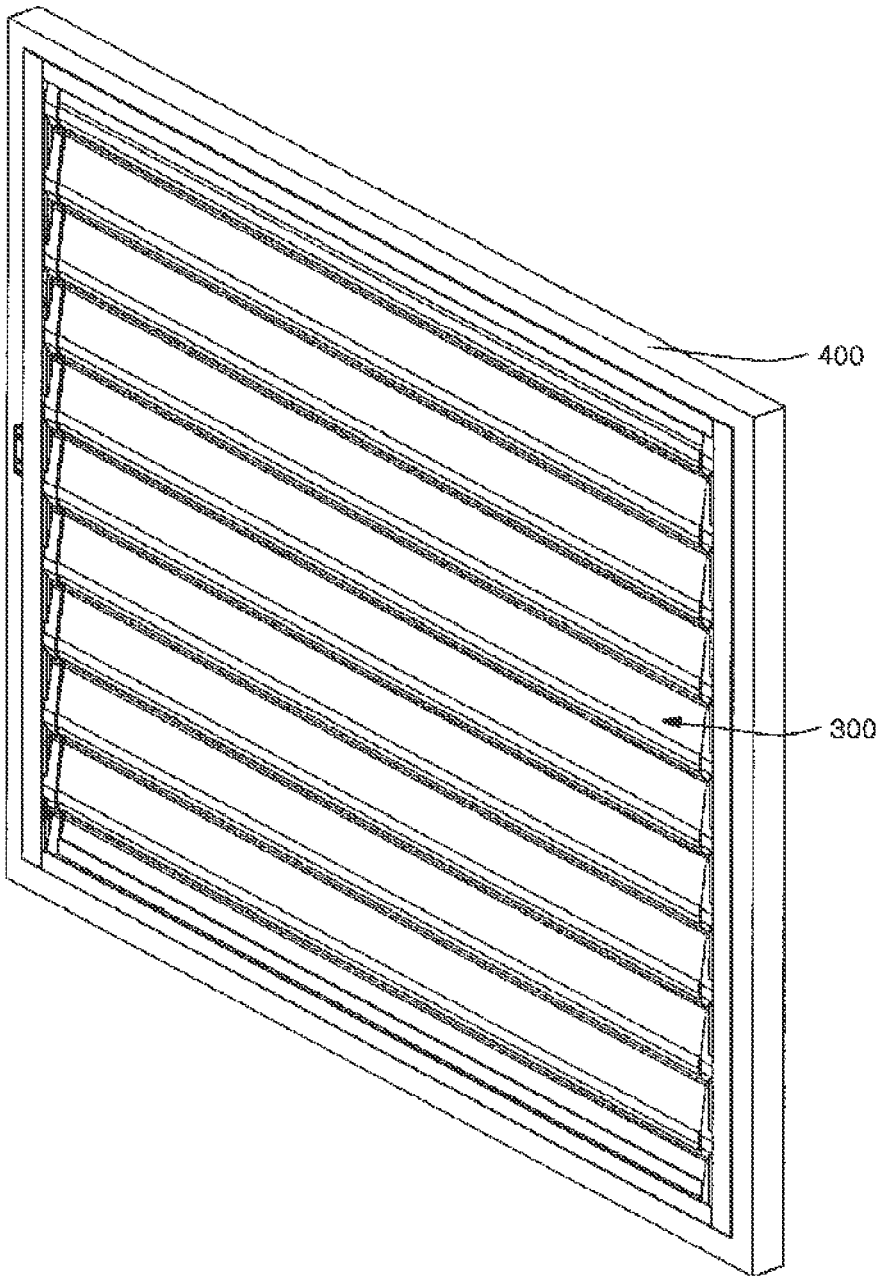
FIG. 29 is a perspective view illustrating an embodiment of a louver system, which illustrates a state in which the louver system is coupled to a chassis in a state in which the louver module is closed.

The louver module according to the embodiment of the present invention may have a configuration shown in FIG. 29. FIG. 29 illustrates a state in which a louver module 300 is coupled to a chassis 400.

Here, the chassis 400 corresponds to a chassis to which a ventilation window or smoke ventilation window of an apartment building, studio apartment or complex building is coupled. The chassis 400 may be installed to have a structure of a fixed type or a structure in which the window can be opened/closed through sliding.

Figure 30:
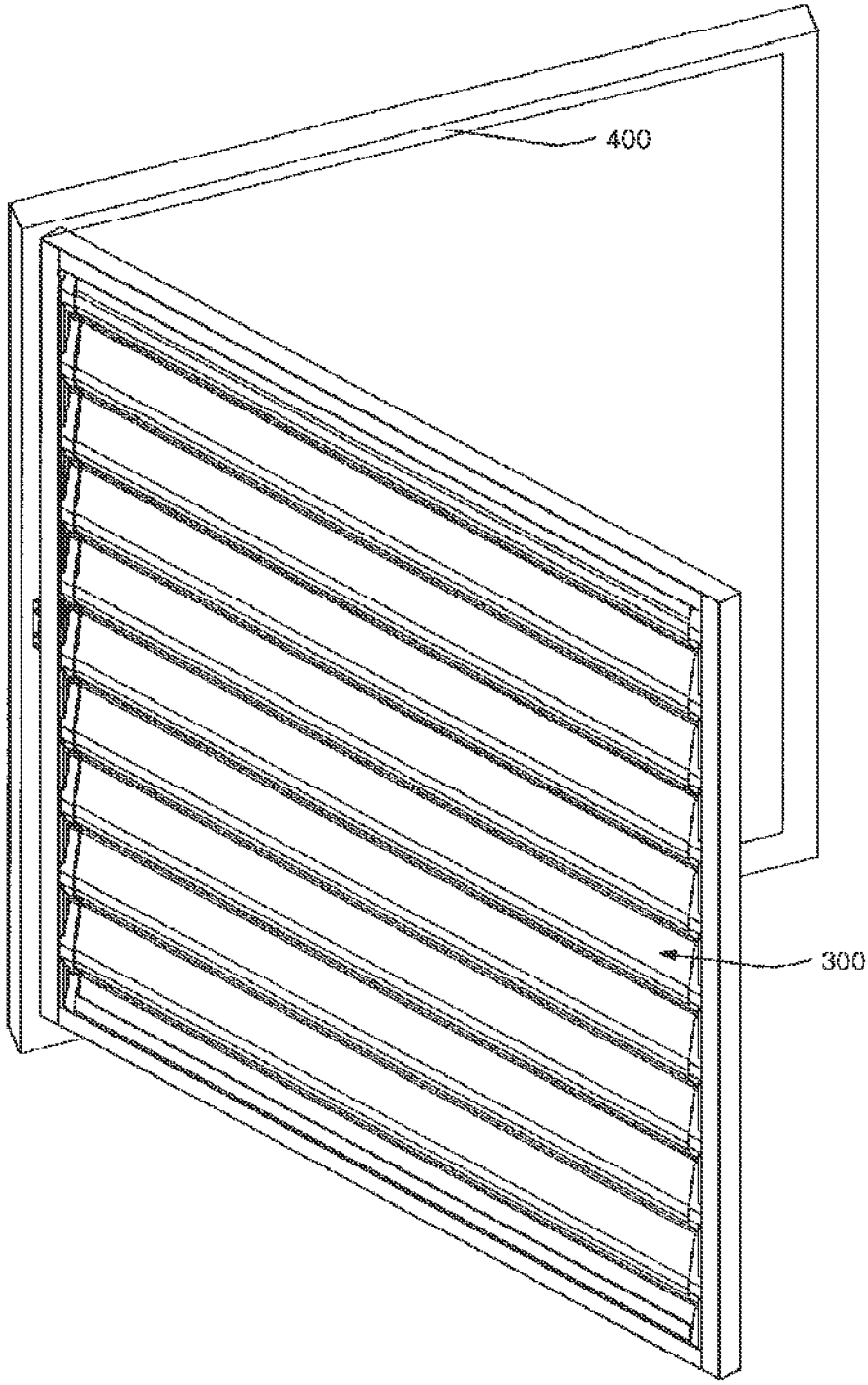
FIG. 30 is a perspective view illustrating an embodiment of the louver system, which illustrates a state in which the louver system is coupled to the chassis in a state in which the louver module is opened.

The louver module 300 according to the embodiment of the present invention may be supported to the chassis 400 so as to be rotatably opened/closed using the vertical or horizontal direction as an axis. In a case where the louver module 300 is supported to the chassis 400 so as to be rotatably opened/closed using the vertical direction as an axis, the opening/closing of the louver module 200 can be performed as shown in FIG. 30.

As described above, the louver module 300 according to the embodiment of the present invention may be variously employed and configured in the louver system.

Although the present invention has been described in connection with the preferred embodiments, the embodiments of the present invention are only for illustrative purposes and should not be construed as limiting the scope of the present invention. It will be understood by those skilled in the art that various changes and modifications can be made thereto within the technical spirit and scope defined by the appended claims.

The invention claimed is:

1. A louver module, comprising:

a frame having horizontal frames and vertical frames assembled in a rectangular shape;

an opening/closing mechanism assembled with any one of the vertical frames so as to provide torque;

a louver unit made of a synthetic resin material and including a plurality of louvers each having a compartment forming an air layer for heat resistance therein, wherein symmetrically-shaped brackets are respectively coupled to both ends in the length direction of the respective louvers, a reinforcing beam extended in the length direction is assembled inside each louver of the louvers, at least one surface of outer surfaces of each louver of the louvers has a curved surface, and the plurality of louvers are rotatably mounted between the vertical frames constituting left and right sides of the frame while being horizontally spaced apart in vertical direction from one another; and a power transmission mechanism including a plurality of holders respectively disposed at positions corresponding to end portions of the louvers inside the vertical frames constituting the frame and a pair of shafts disposed inside each vertical frame of the vertical frames, wherein each holder of the holders has one surface on which a fixing projection is formed and the other surface on which a pair of link projections are formed, the fixing projection of the holder is coupled to the end portion in the length of the reinforcing beam by passing through the vertical frame and a bracket of the brackets, corresponding to the position of the fixing projection, the link projections of each holder of the holders are linked with the respective shafts, and the end portions of the pair of link projections of a specific holder corresponding to the mounting position of the opening/closing mechanism are mounted to the opening/closing mechanism by passing through the linked shafts, wherein the torque is transmitted to the specific holder from the opening/closing mechanism, the pair of shafts are driven in opposite directions to each other by rotation of the specific holder so that the torque is transmitted to other holders, as the holders inside the vertical frame forming one side of the frame are rotated, the torque is transmitted to the louver to be rotated, the holders inside the vertical frame forming the other side of the frame are rotated in connection with the rotation of the louvers coupled to the respective holders, and the pair of shafts inside the vertical frame forming the other side of the frame, which are linked with the holders, are driven in opposite directions to each other.

2. The louver module according to claim 1, wherein the opening/closing mechanism comprises:

a driving mechanism providing an original driving force;

a worm gear including a worm rotated by the original driving force transmitted from the driving mechanism and a first wheel tooth-combined with the worm so as to generate the torque in a direction vertical to the original driving force; and a second wheel shaft-coupled to the first wheel of the worm gear so as to be rotated by receiving the torque transmitted from the first wheel, and coupled to the pair of link projections of the holder at a position corresponding to the second wheel.

3. The louver module according to claim 2, wherein the driving mechanism includes a knob shaft-coupled to the worm and rotated by a user's hand.

4. The louver module according to claim 2, wherein the driving mechanism includes an electric motor rotated by a user's manipulation and shaft-coupled to the worm.

5. The louver module according to claim 1, wherein the louver unit further includes fixed louvers respectively coupled to uppermost and lowermost portions of the frame in a state corresponding to the state in which the louver is closed.

6. The louver module according to claim 1, wherein the bracket of the louver unit further includes at least one of a wedge and a fixing screw, which are coupled to an end portion in the length direction of the louver by passing through the bracket.

7. The louver module according to claim 1, wherein the louver is coupled to the frame so that the curved surface of the louver becomes an outer surface, each of the brackets respectively coupled to both ends in the length direction of the louver further includes a beak that comes in contact with a short edge formed on the vertical frame contacting the bracket in the state in which the louver is closed while being extended downward along the curved surface of the louver, and rainwater is guided to the curved surface of another louver positioned beneath the louver by the beak in the state which the louver is closed so as to prevent the rainwater from flowing in the interior.

8. The louver module according to claim 1, wherein a gasket is further inserted into the louver so as to be parallel with the other surface of the louver, which contacts the curved surface of another louver disposed beneath the louver in the state in which the louver is closed.

9. A louver system, comprising:

the louver module according to claim 1; and a chassis supporting the louver module to be rotatably opened/closed.

10. The louver system according to claim 9, wherein the chassis supports the louver module to be rotatably opened/closed using the horizontal direction as an axis.

11. The louver system according to claim 9, wherein the chassis supports the louver module to be rotatably opened/closed using the vertical direction as an axis.

12. The louver system according to claim 9, wherein the chassis is assembled with the louver module to be rotatably opened/closed using the horizontal direction as the axis, and the chassis is coupled to a window having a sliding opening/closing function.

13. The louver system according to claim 9, wherein the chassis is fixed and coupled to an external chassis.

* * * * *